US012529514B2

(12) United States Patent
Bradley

(10) Patent No.: US 12,529,514 B2
(45) Date of Patent: Jan. 20, 2026

(54) COOLER FOR HOLDING BEVERAGE CONTAINERS

(71) Applicant: Danby Products Limited, Guelph (CA)

(72) Inventor: Oliver Bradley, Guelph (CA)

(73) Assignee: DANBY PRODUCTS LIMITED, Guelph (CA)

( * ) Notice: Subject to any disclaimer, the term of this patent is extended or adjusted under 35 U.S.C. 154(b) by 153 days.

(21) Appl. No.: 18/378,282

(22) Filed: Oct. 10, 2023

(65) Prior Publication Data

US 2024/0125542 A1 Apr. 18, 2024

Related U.S. Application Data

(60) Provisional application No. 63/415,529, filed on Oct. 12, 2022.

(51) Int. Cl.

| | |
|---|---|
| ***F25D 31/00*** | (2006.01) |
| ***F25D 23/02*** | (2006.01) |
| ***F25D 23/06*** | (2006.01) |

(52) U.S. Cl.

CPC ..... *F25D 31/007* (2013.01); *F25D 23/028* (2013.01); *F25D 23/067* (2013.01); *F25D 2500/02* (2013.01)

(58) Field of Classification Search

CPC ..... F25D 25/024; F25D 2325/021

See application file for complete search history.

(56) References Cited

U.S. PATENT DOCUMENTS

| | | | | |
|---|---|---|---|---|
| 3,870,155 | A * | 3/1975 | Galloway | A47B 73/006 211/74 |
| 2005/0211648 | A1* | 9/2005 | Haller | A47B 57/04 211/75 |
| 2021/0137288 | A1* | 5/2021 | Fagundes | A47B 96/025 |

* cited by examiner

*Primary Examiner* — Ana M Vazquez

(74) *Attorney, Agent, or Firm* — Ralph E. Jocke; WALKER & JOCKE

(57) ABSTRACT

A beverage cooler (10) includes a plurality of shelves (26). At least some of the shelves have a front portion (50) that is rotationally movable between a position in which the front portion is in co-planar relation with a back portion (50), and a position in which the front portion extends an acute angle relative to the back portion. The front portion is also movable to a retracted position in which the front portion underlies the back portion. Some shelves have slots (98) in which removable inserts (58) are positionable. Opposed edges of the inserts include projections and recesses having different spaced configurations. The shelves can be used for supporting different sizes and configurations of containers by having a selected edge of the insert extend upward outside of the slot.

23 Claims, 18 Drawing Sheets

COOLER FOR HOLDING BEVERAGE CONTAINERS

TECHNICAL FIELD

Exemplary arrangements relate to devices that hold beverage containers at selected cool temperatures. Specifically, exemplary arrangements relate to a wine cooler apparatus with configurable shelf arrangements that enable supporting bottles or similar beverage containers in selected orientations.

BACKGROUND

It is often desirable to maintain certain beverages at selected temperatures. An example of a type of beverage that is desirable to maintain at a selected temperature is wine. However it may be desirable to maintain other types of beverages at selected temperatures.

The organized storage of beverages within a cooler apparatus may be accomplished using different types of shelves. However, a shelf configuration that may be suitable for holding one size or type of a beverage container, may not be suitable for holding other sizes and types of beverage containers.

Beverage holding coolers and the shelves that are used therein for supporting beverage containers may benefit from improvements.

SUMMARY

Exemplary arrangements provide an apparatus including a cooler configured for holding beverage containers. The exemplary apparatus includes an enclosure which bounds an interior area. The enclosure includes an opening to the interior area from outside the enclosure. A door that is movably mounted to the enclosure is movable between a closed door position in which the door prevents access from outside the enclosure to the interior area, and an open position in which the interior area is accessible from outside the enclosure. The exemplary door includes a transparent front panel that enables viewing of the beverage containers housed within the interior area.

The exemplary cooler apparatus includes a plurality of vertically spaced parallel, horizontally extending shelves. The exemplary shelves include at least one configurable shelf. The at least one configurable shelf includes a front portion and a back portion. The exemplary front portion is rotatably movable relative to the back portion.

In the exemplary arrangement the front portion is configured to be releasably fixed in a plurality of positions relative to the back portion. These positions include a flat shelf position in which the front portion is in co-planar relation with the back portion. Another of the positions is a tilted position in which the front portion extends at an acute angle relative to the back portion, and in which an inward end of the front portion that is immediately adjacent to the back portion extends vertically above the back portion. The exemplary shelf further enables a front portion be placed in a retracted position. In the retracted position the front portion is disposed rearward and is in at least one of overlying or underlying relation with at least a portion of the back portion.

Exemplary arrangements further include immediately vertically adjacent configurable shelves. Such arrangements enable the front portion of the lower shelf to be in a tilted position such that beverage containers such as bottles may be positioned in a tilted configuration in engagement with the front portion. In such an arrangement the front portion of the configurable shelf immediately above the shelf supporting bottles in the tilted configuration, is positioned in the retracted position. This enables the necks of the bottles on the lower shelf to extend upward to a vertical level of at least that of the shelf above. Because the front portion of the shelf above is in the retracted position, the upper shelf of the pair does not interfere with the upwardly tilted bottles supported on the front portion of the lower shelf. Numerous different shelf arrangements and configurations may be provided for supporting beverage containers in a desired manner.

Exemplary arrangements may include horizontally extending shelf support plates that have an elongated, horizontally extending slot. The slots are configured to receive at least one resilient insert therein. The exemplary insert includes a plurality of horizontally spaced projections that extend outward from and vertically above the slot when the insert is positioned within the slot. The spaced projections serve to engage and hold beverage containers in a desired spaced relation. In some arrangements exemplary the inserts may include different spaced arrangements of projections on the opposed horizontal edges thereof. This enables a single insert to be utilized for holding different sizes and configurations of beverage containers based on how the insert is oriented when positioned in the slot.

Numerous other useful aspects of the exemplary arrangements are described in the following Detailed Description.

DETAILED DESCRIPTION

Figure 1:
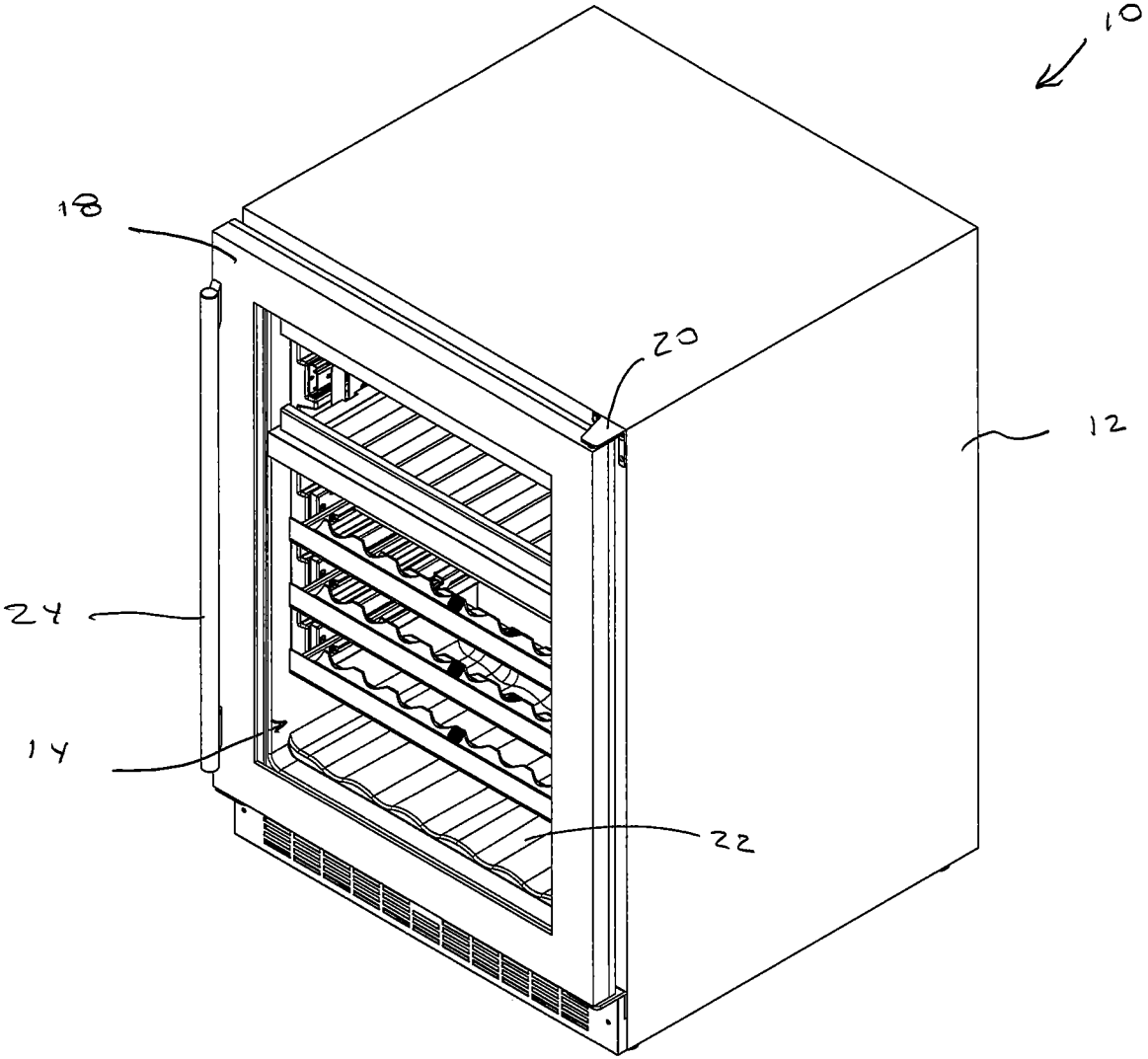
FIG. 1 is a perspective view of an exemplary beverage cooler apparatus shown with the door in the door closed position.

Referring now to the drawings and particularly to FIG. 1 there is shown therein an exemplary arrangement of a beverage cooler apparatus generally indicated 10. The exemplary beverage cooler apparatus is configured for holding beverage containers therein at a set desired temperature. The exemplary cooler includes an enclosure 12. The enclosure 12 bounds an insulated interior area 14. The enclosure includes an opening 16 that enables accessing the interior area 14 from outside the enclosure.

Figure 2:
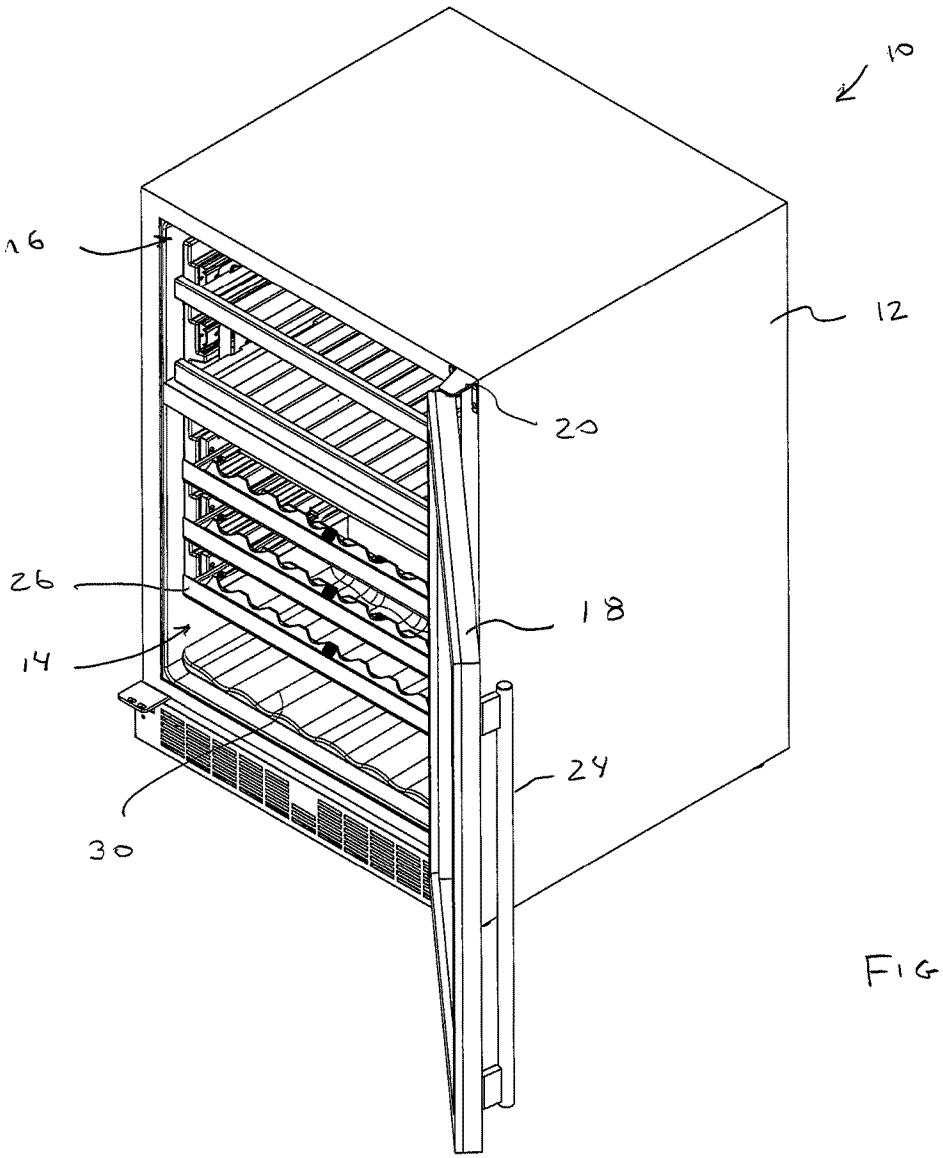
FIG. 2 is a perspective view of the beverage cooler apparatus of FIG. 1 with the door in a door open position.

A door 18 is movably mounted in operative connection with the enclosure through a pair of vertically disposed hinges 20. The exemplary door includes a transparent panel 22 which enables viewing the interior area 14 through the door. The door 18 further includes an external handle 24. The door is movable relative to the enclosure between positions including a door closed position as shown in FIG. 1. In the door closed position the door prevents access to the interior area from outside the enclosure. The door is movable from the door closed position to the door open position as shown in FIG. 2. In the door open position the interior area 14 is accessible from outside of the enclosure. Of course it should be understood that this configuration for the cooler is exemplary and other types of configurations may be utilized.

The exemplary cooler further includes components that facilitate maintaining the interior area at a set desired temperature. In exemplary arrangements this includes a refrigerant compressor, evaporator and condenser that provide for heat transfer from the interior area 14 to outside the interior area through use of a suitable refrigerant material. Exemplary arrangements further include circuitry that is configured to control the refrigeration components, including a temperature sensor and a thermostat which are operative to maintain the interior area at a desired temperature. Further exemplary arrangements may include lights or other components within the interior area. It should be understood that these cooler components are exemplary and other arrangements may include different or other components.

Figure 3:
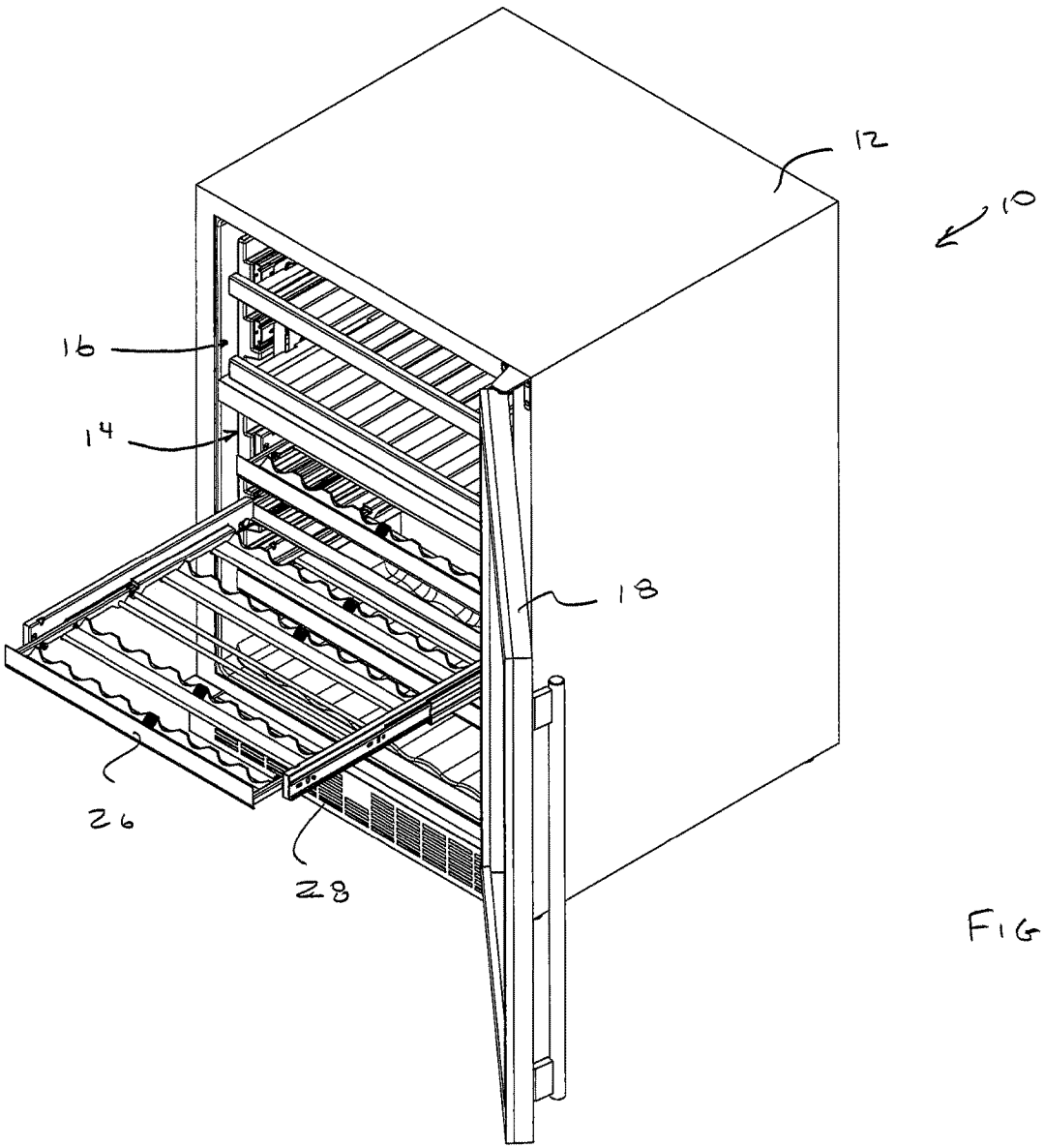
FIG. 3 is a view similar to FIG. 2 but with a shelf shown extending outward from the interior area of the cooler.

In the exemplary arrangement the cooler includes a plurality of vertically spaced, parallel horizontally extending shelves 26. In exemplary arrangements the vertically spaced shelves include at least one configurable shelf that is movable between multiple positions and configurations in a manner like that later discussed. Each of the plurality of configurable shelves of the exemplary arrangement is supported on a pair of horizontally opposed slides 28. In exemplary arrangements with the door in the door open position the configurable shelves are movably extendable outwardly from the interior area 14 through the opening 16. In the exemplary arrangement shown each of the configurable shelves is movable in supported connection with the slides 28 such that when the slides are in a slide retracted position as shown in FIG. 2 the shelves are disposed fully within the interior area. In the slide extended position such as is shown in FIG. 3, the exemplary slide and shelf extend outwardly from the enclosure. Of course it should be understood that this configuration is exemplary and in other arrangements other configurations and approaches may be used.

The exemplary cooler configuration also includes at least one fixed shelf 30. In the exemplary arrangement the fixed shelf 30 is not extendable outward through the opening 16 in supported connection with retractable slides. Of course it should be understood that this configuration having both movable shelves and fixed shelves is exemplary and in other arrangements other approaches may be used.

Figure 7:
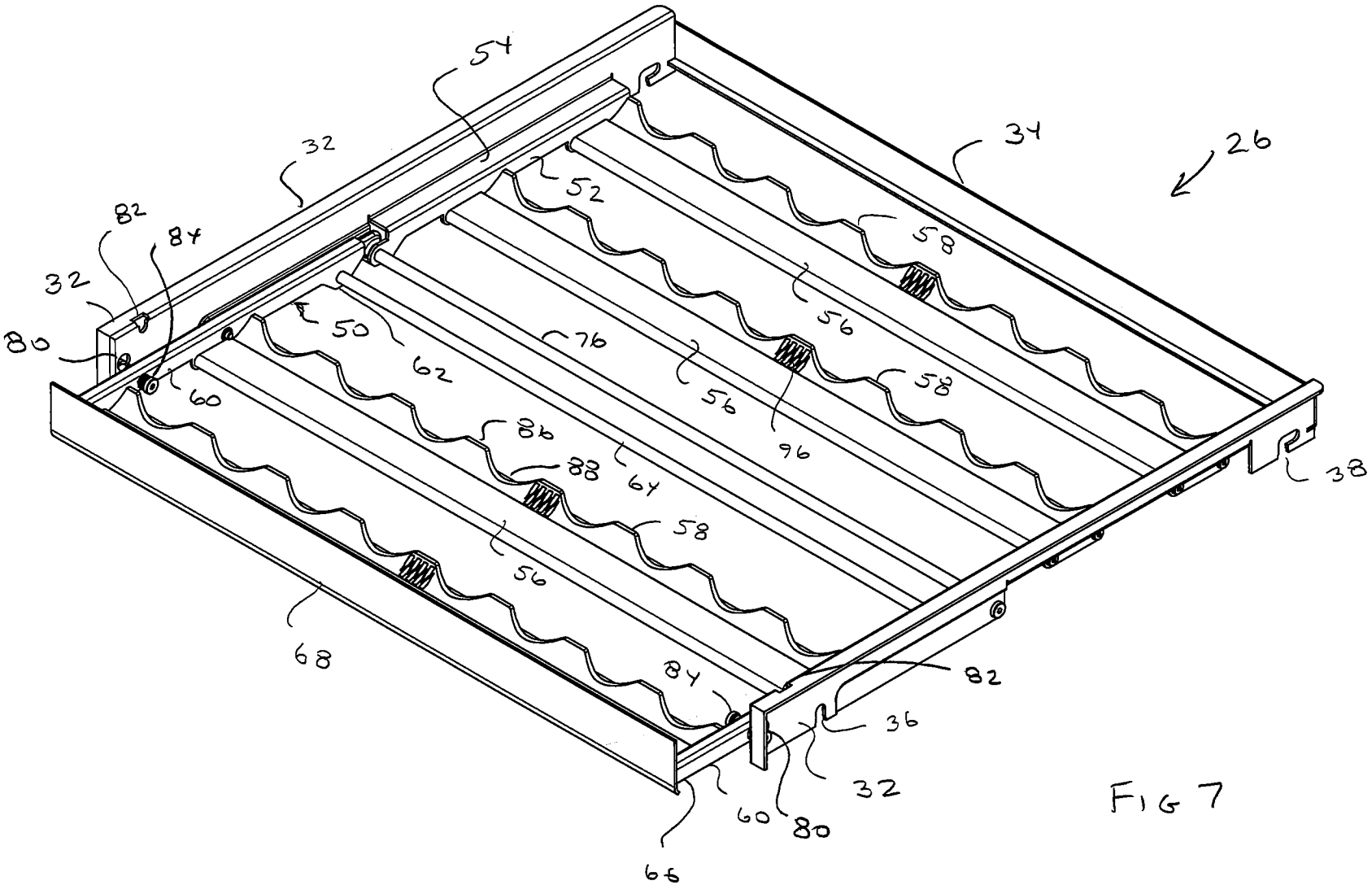
FIG. 7 is a front top right perspective view of an exemplary configurable shelf shown with the front portion in a flat shelf position.
Figure 8:
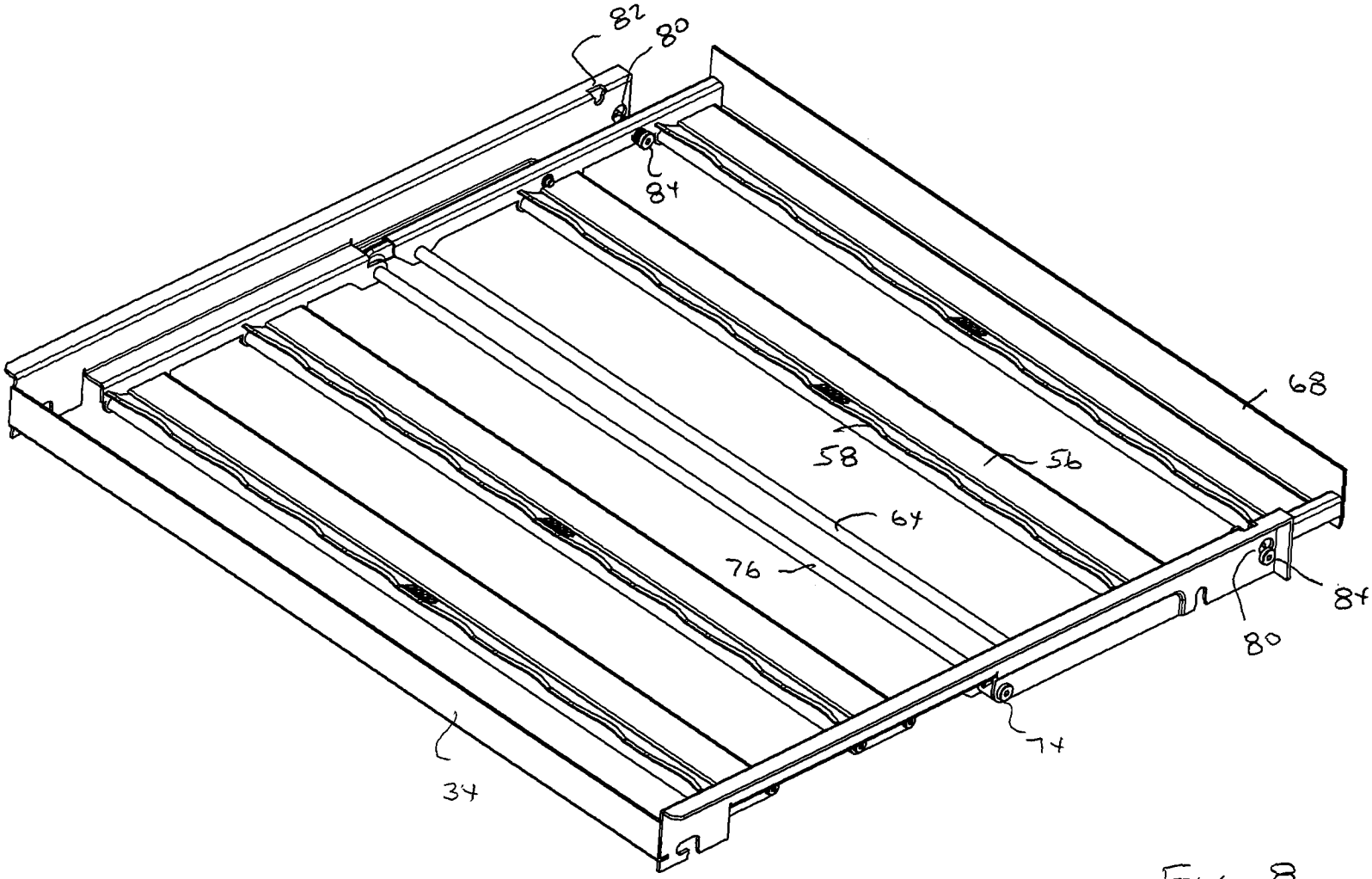
FIG. 8 is a top back left perspective view of the shelf as shown in FIG. 7.
Figure 9:
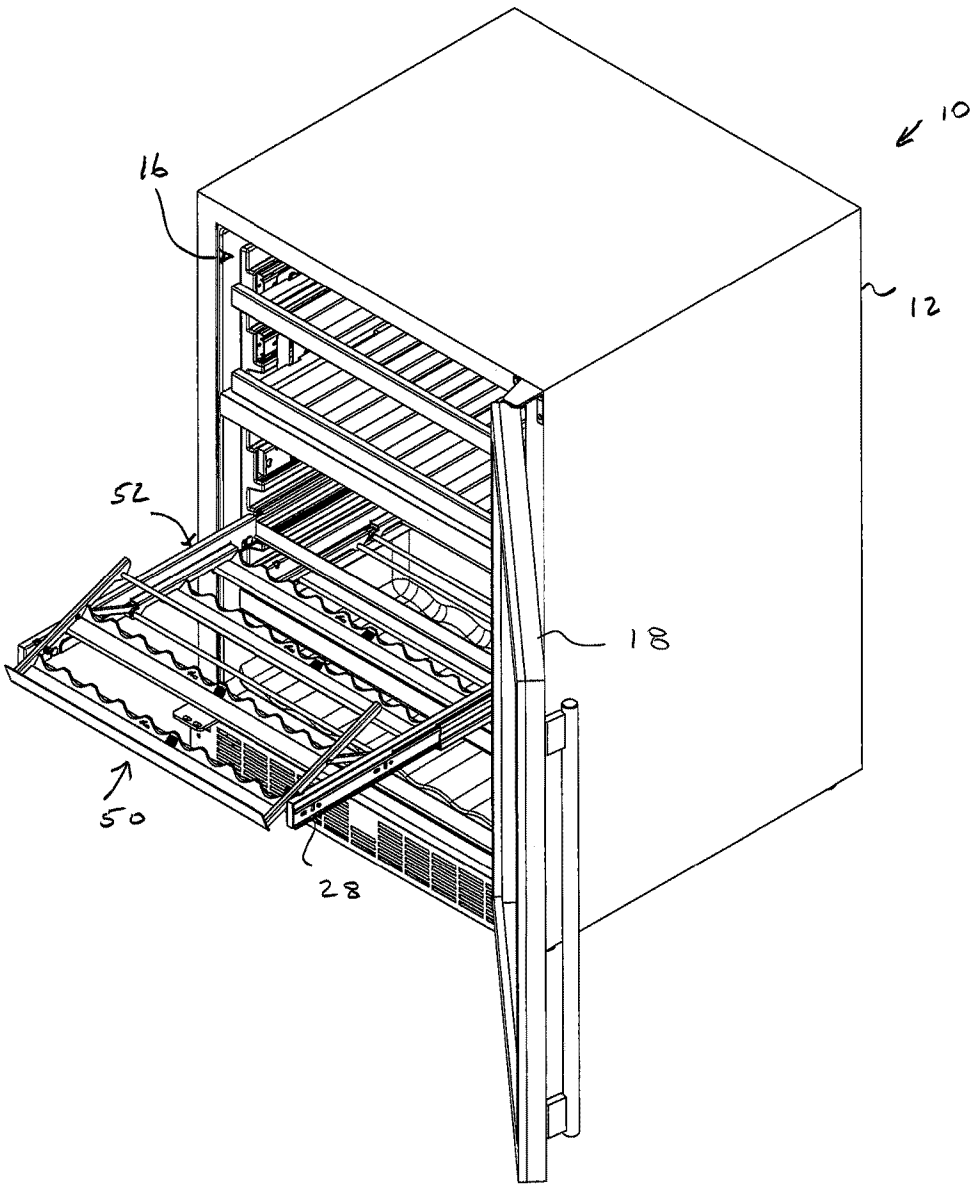
FIG. 9 is a top front right perspective view of the exemplary cooler shown with the configurable shelf extended and having the front portion thereof in a tilted position.

As shown in FIGS. 7 and 8 each configurable shelf 26 of the exemplary arrangement in the operative position includes a pair of horizontally disposed side walls 32. A back shelf wall 34 in the operative position extends horizontally between the side walls 32 and is in operatively fixed connection therewith. In the exemplary arrangement each side wall includes slots therein that enable releasable engagement with a respective side wall. As a result a shelf can be held in fixed engagement with an adjacent slide. For example in the exemplary arrangement each side wall includes a front slot 36 and a back slot 38. In the exemplary arrangement and in an operative position of the shelf, the front slot 36 extends vertically from a lower edge of the side wall. In the exemplary arrangement the back slot 38 extends vertically from an edge of the side wall and then horizontally from the vertically extending back slot portion.

Figure 4:
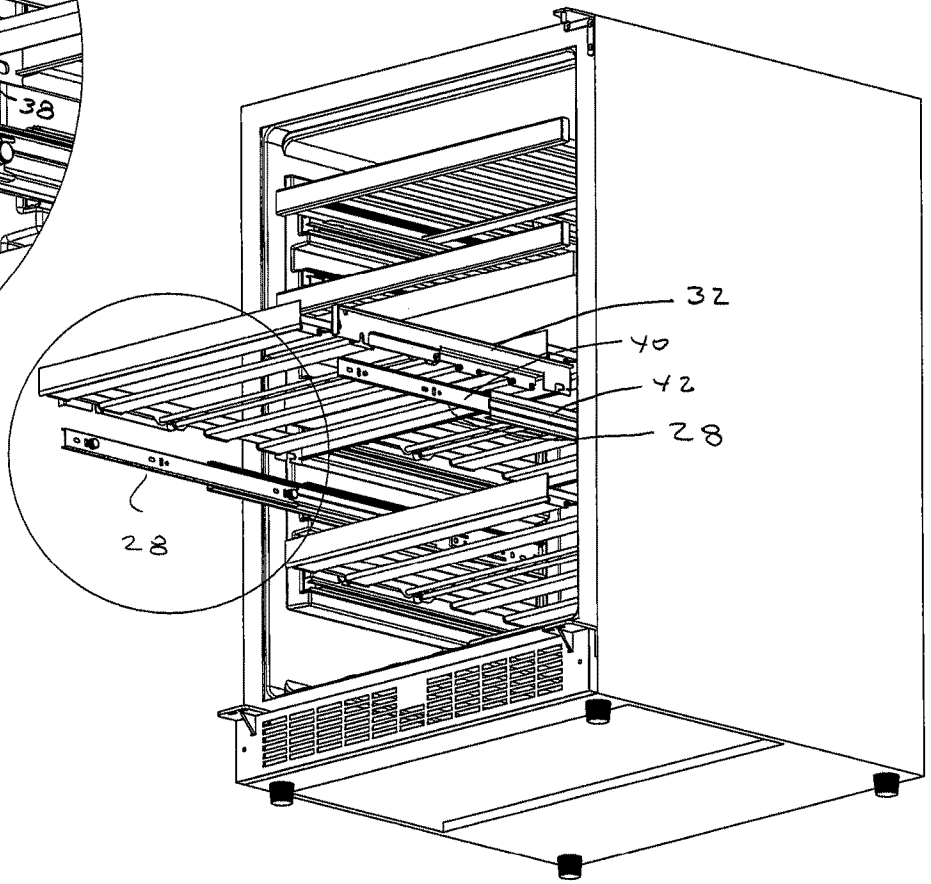
FIG. 4 is a bottom front right perspective exploded view of the cooler shown in FIG. 3 showing the exemplary shelf and extendable slides.
Figure 5:
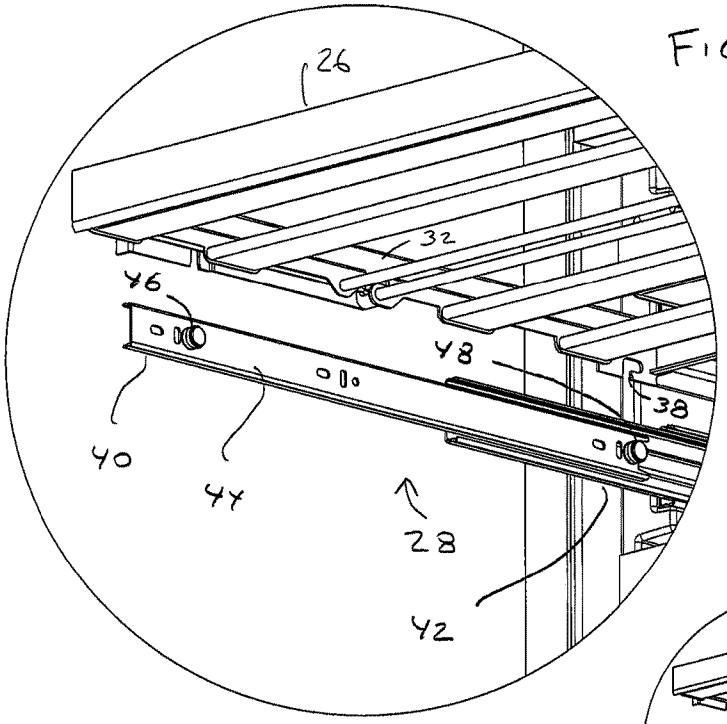
FIG. 5 is an enlarged view of a slide and an exemplary configurable shelf.

As shown in FIGS. 4 and 5, each of the slides 28 includes a front slide portion 40 that is movably extendable outward from a back slide portion 42. In the exemplary arrangement an inward facing surface 44 of each slide includes a pair of disposed releasable fasteners. The exemplary fasteners include a forward slide fastener 46 and a back slide fastener 48. As can be appreciated from FIGS. 4 and 5, in the exemplary arrangement the fasteners extend in threaded engagement through openings in the front slide portion 40. The exemplary fasteners each include a threaded cylindrical stud portion and an enlarged head.

To engage an immediately adjacent side wall of a shelf 26 with a slide, the back slide fastener 48 and the forward slide fastener 46 are loosened. With the back slide fastener 38 loosened the cylindrical stud portion of the fastener is enabled to extend in the vertical portion of the back slot 38 of the side wall 32. When the cylindrical stud portion of the fastener reaches the furthest extent of vertical travel in the slot 38, the exemplary shelf is then moved forwardly relative to the front slide portion so that the cylindrical stud portion of the fastener extends in the horizontally extending portion of the slot 38. With the cylindrical stud portion of the fastener 38 engaged at the furthest horizontal position of the back slot 38 away from the vertically extending portion of the slot, the cylindrical stud portion of the forward slide fastener is enabled to be engaged in the front slot 36. The forward slide fastener and back slide fastener are then tightened to hold the immediately adjacent side wall 32 in engagement with the front slide portion 40. Due to the configuration of the exemplary arrangement a user is enabled to engage a configurable shelf with each of a pair of horizontally disposed slides 28. As can be appreciated this exemplary mounting arrangement enables readily engaging and disengaging the exemplary shelves 26 from the slides 28. Of course it should be understood that this arrangement is exemplary and in other arrangements other approaches may be used.

An exemplary configurable shelf 26 is shown in greater detail in FIGS. 6 through 15. In the exemplary arrangement the configurable shelf includes a front portion 50 and a back portion 52. In the exemplary arrangement the front portion 50 is rotationally movably positionable relative to the back portion between the side walls 32. The exemplary back portion 52 is in operatively fixed connection with each of the side walls 32. The exemplary back portion includes an inward projection piece 54. Each inward projection piece is generally L-shaped in transverse cross-section and bounds an elongated cross-sectional recess on a lower side of the shelf. As later discussed the elongated cross-sectional recess is configured for accepting portions of a link which is connected to the front portion therein. In exemplary arrangements shelf support plates 56 extend horizontally between the side walls and the inward projection pieces 54. As later discussed each of the exemplary shelf support plates include horizontally elongated slots which are configured to releasably receive inserts 58 therein.

The exemplary front portion 50 includes a pair of horizontally disposed front side links 60. In the exemplary arrangement each front side link in transverse cross section includes an internal elongated cross-sectional recess therein. The elongated recess in each front side link 60 is configured to receive a portion of a back side link therein as later discussed. The exemplary front side links are rotationally movable intermediate of the side walls 32 into various positions as later discussed. Each of the exemplary front side links include a back front side link end 62. A front rod 64 extends horizontally between the respective back front side link ends 62.

In the exemplary arrangement each front side link includes a forward front side link end 66. The front side links are connected by a front wall 68 at the forward front side link ends. A pair of shelf support plates 56 extend horizontally between the front side links 60. The exemplary shelf support plates 56 include elongated slots for releasably receiving inserts 58 in a manner like that later discussed.

Figure 10:
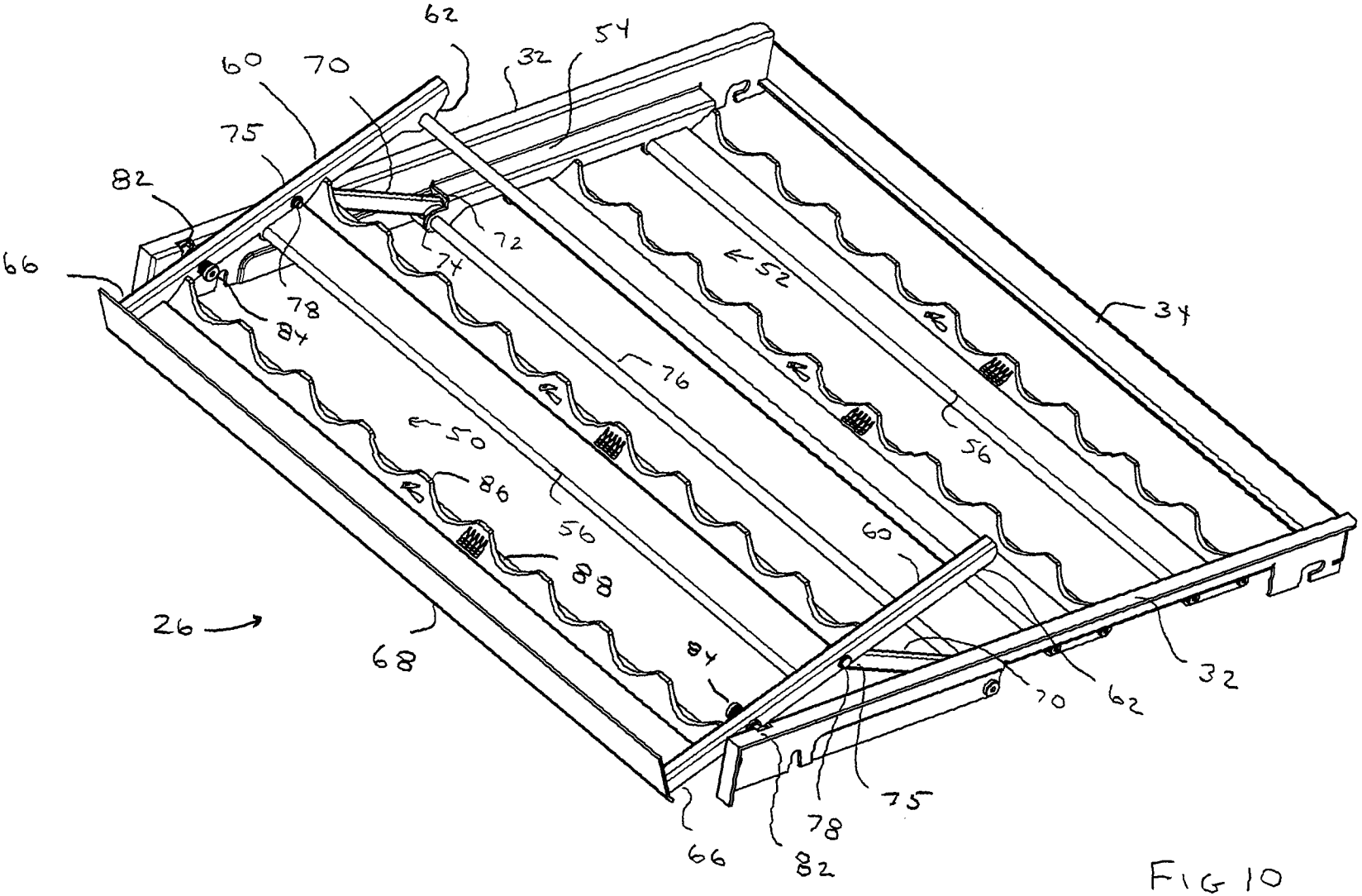
FIG. 10 is a top front right perspective view of a configurable shelf with the front portion in a tilted position.
Figure 11:
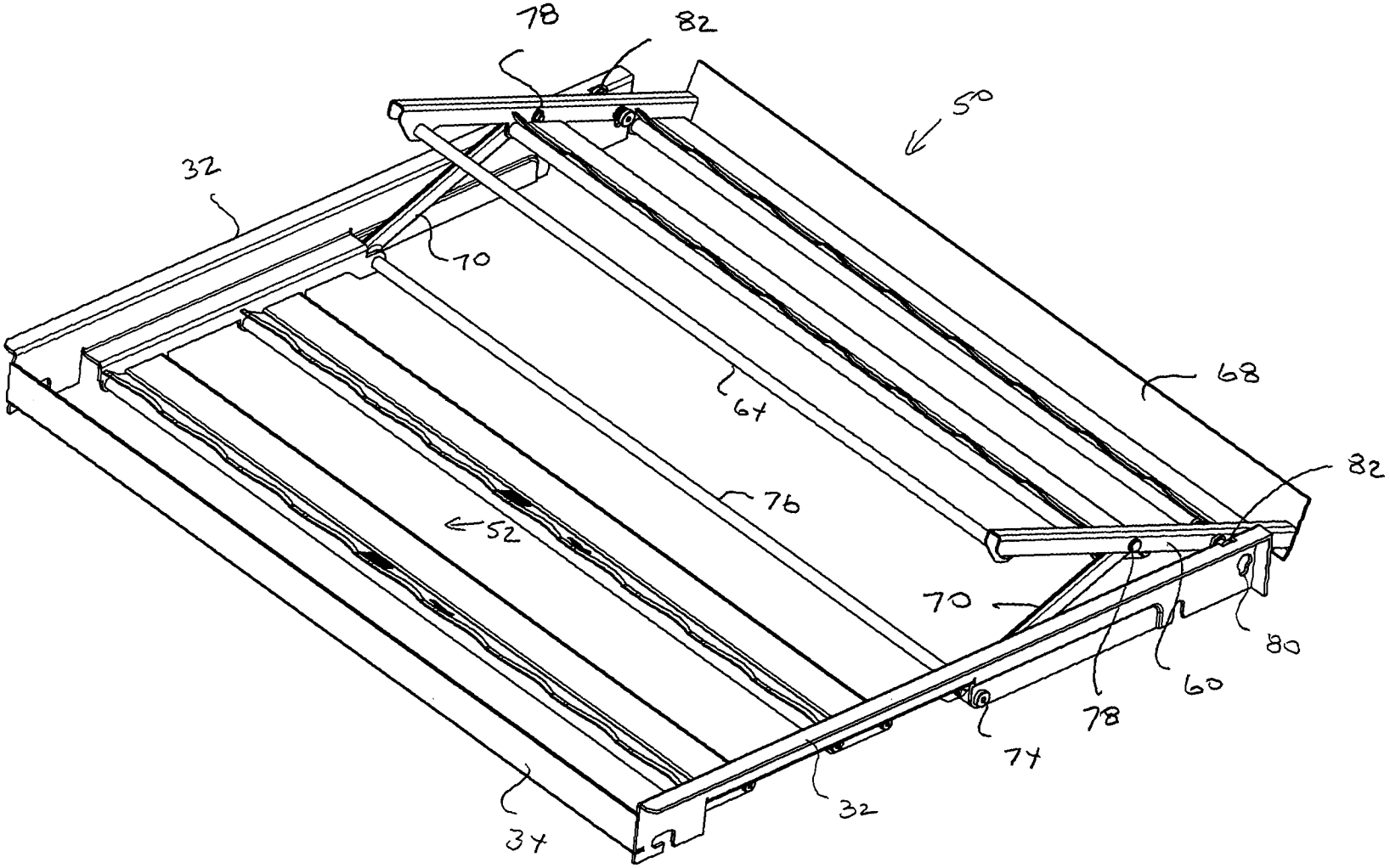
FIG. 11 is a back front left perspective view of the shelf shown in FIG. 10 with the front portion in a tilted position.

As is better shown in the tilted position of the shelf front portion in FIGS. 10 and 11, a pair of horizontally disposed back side links 70 are rotationally movably mounted in operative connection with the side walls 32. Each back side link 70 includes a first back side link end 72 and a second back side link end 75. The first back side link end 72 is rotationally movably mounted in operative connection with the respective side wall about a rear pivot 74. In the exemplary arrangement a portion of the first back side link end 72 extends in the elongated cross sectional recess of inward projection piece 54. A back rod 76 extends between the inward projection pieces 54 along the axis of the rear pivot 54. In exemplary arrangements the back rod 76 may serve as the support of the rear pivot 74 about which the back side links 70 rotate. Of course this approach is exemplary and in other arrangements other approaches may be used.

In the exemplary arrangement the second back side link end 72 is pivotally engaged with the front side link 60. The second back side link end 75 is engaged with the front side link at a front side link pivot 78. In exemplary arrangements the second back side link end extends in the elongated cross-sectional recess of the front side link and pivots therein. The exemplary front side link pivot is positioned in generally centered intermediate relation between the forward front side link end 66 and the back front side link end 62. As can be appreciated this exemplary configuration enables the respective front side links to be vertically and rotationally movable along the direction that is parallel to the immediately adjacent side wall 32. Of course it should be understood that this configuration is exemplary, and in other arrangements other approaches may be used.

In the exemplary arrangement each side wall 32 includes a first aperture 80. In the exemplary arrangement each of the first apertures 80 are horizontally aligned. Each exemplary side wall 32 further includes a second aperture 82. In the exemplary arrangement each of the second apertures are also horizontally aligned. In the exemplary arrangement the first apertures 80 are positioned on a respective side wall 32 forward of and below the second apertures 82.

Each exemplary front side link 60 includes a respective horizontally outward extending projection 84. The exemplary outward extending projections are disposed outwardly away from the front side link pivot 78 and toward the respective forward front side link end of the respective front side link 60. In the exemplary arrangement the outward extending projections 84 each comprise a releasable fastener that extends through a respective aperture in the front side link. Of course it should be understood that this configuration of the projections 84 is exemplary. In other arrangements the horizontally extending projections may include pins, studs or other structures that may be permanently part of the respective front side link or releasably engageable with the respective front side link as is the case in the exemplary arrangement.

In the exemplary arrangement the first aperture 80 has a keyhole configuration with an enlarged central portion and a more narrow downward extending slot portion. In exemplary arrangements the horizontally extending projection is attached to a cylindrical stud portion which terminates outwardly in an enlarged head. In the exemplary configuration the head and stud portion are configured to pass through the enlarged circular portion of the aperture, while the stud portion is configured to pass through the smaller vertically extending portion of the aperture 80. The exemplary horizontally extending projection includes a fastener that enables releasably engaging the front side link and the side wall 32 in fixed engagement when the stud portion extends in the vertically extending portion of the aperture 80. In the exemplary arrangement the second aperture 82 includes a slot in an upper face of the respective side wall 32 as shown. The second aperture includes an enlarged portion that enables the head to pass therethrough and a vertically extending slot portion that can be similarly engaged with the stud portion of the projection therein. In the exemplary arrangement this enables the horizontally extending projection to be selectively held in releasably fixed engagement with the second aperture 82.

Figure 17:
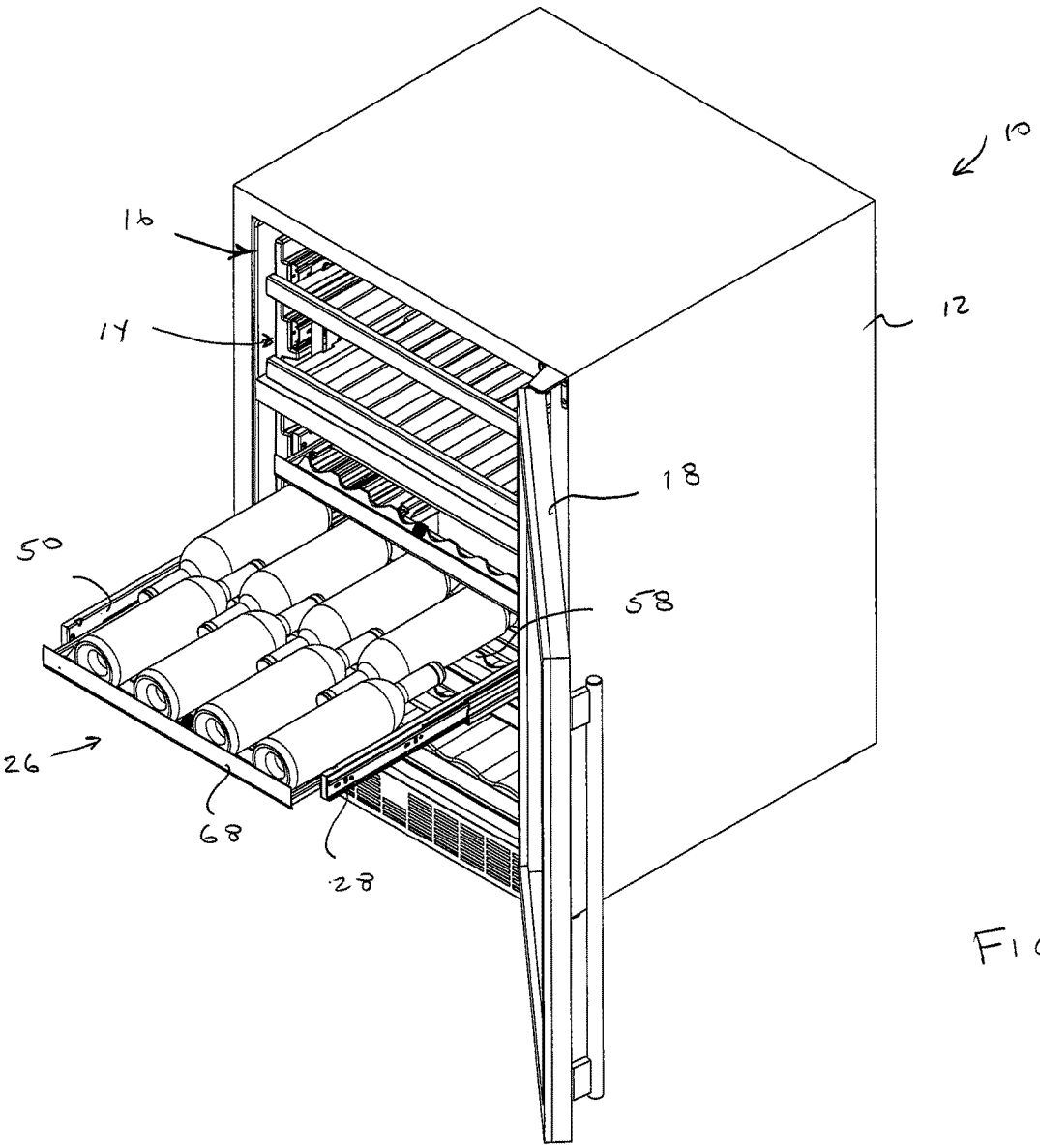
FIG. 17 is a front top right perspective view of the exemplary cooler shown with a configurable shelf with the front portion in a flat shelf position and extended outward from the opening of the enclosure.

As a result in the exemplary arrangement the horizontally extending projections may be extended through the first apertures 80 and the side walls 32 and selectively held in fixed engagement therewith. In this arrangement the front portion 50 is in fixed co-planar relation with the back portion such that the front portion is in the flat shelf position as represented in FIGS. 7 and 8. As shown in FIG. 17 for example, with the front portion in the flat shelf position containers may be positioned in operative supported connection with the exemplary configurable shelf in a manner like that shown in FIG. 17.

Figure 18:
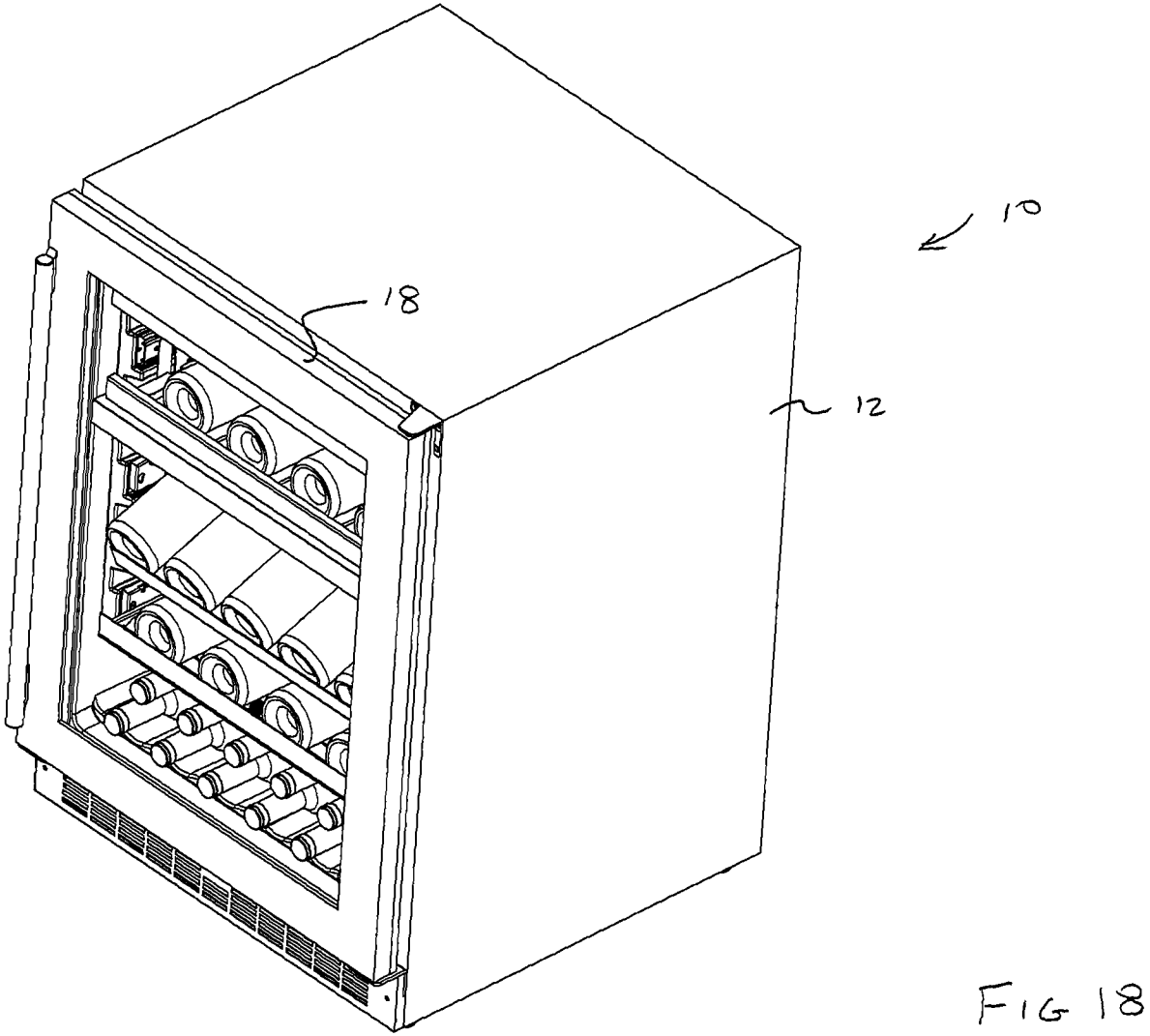
FIG. 18 is a further front top right perspective view of the exemplary cooler shown with a different shelf configuration including a configurable shelf with the front portion in the tilted position.
Figure 19:
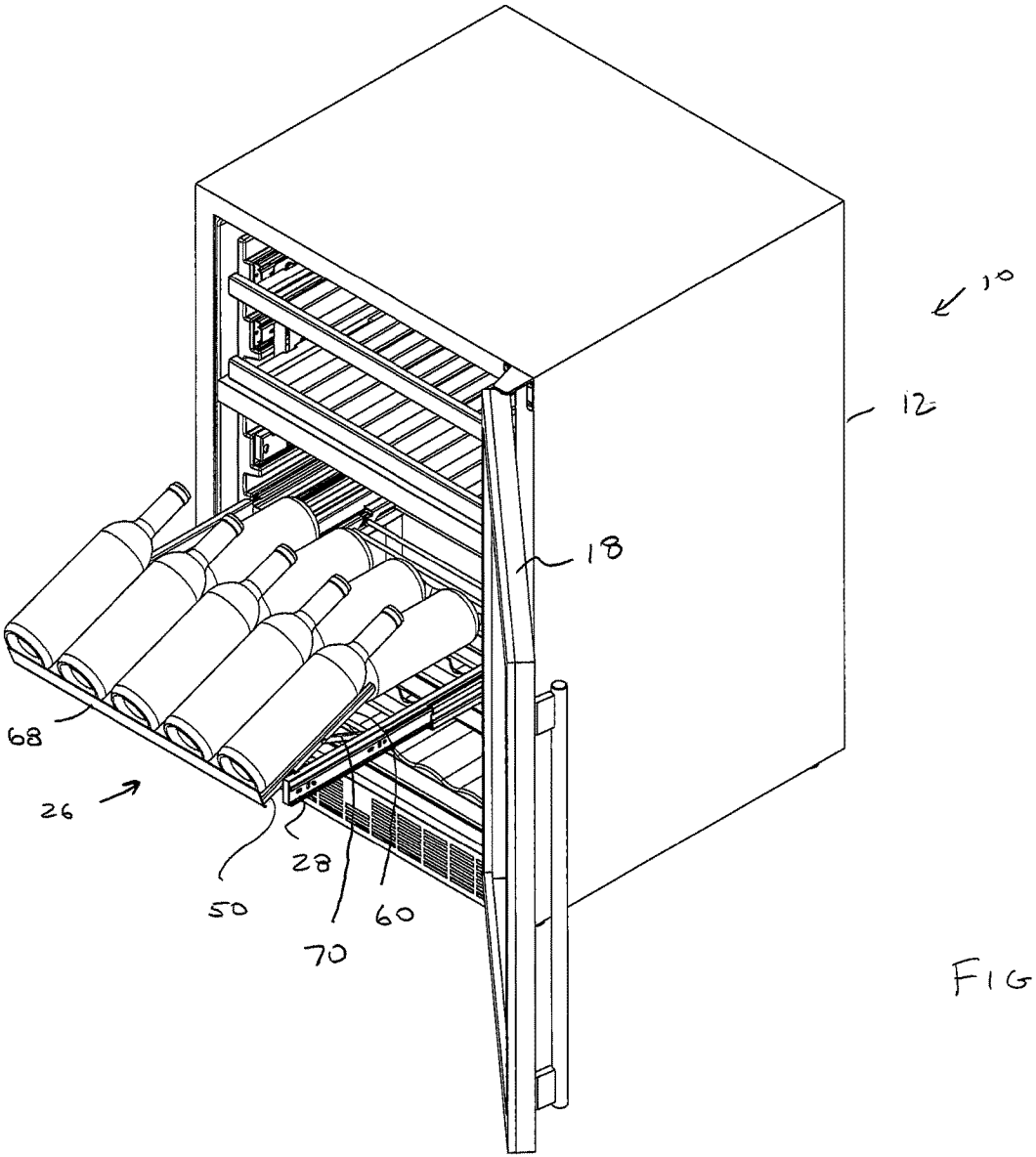
FIG. 19 is a top front right perspective view of the cooler as shown in FIG. 18 but with a configurable shelf with the front portion in the tilted position extended outward from the opening on the pair of slides.

When desired the user is enabled to configure the front portion 50 in a tilted position. This is accomplished by disengaging the horizontally extending projections 84 from the first apertures 80 and engaging the horizontally extending projections in fixed engagement with the second apertures 82. As the front portion moves between the flat shelf position and the tilted position the front side links and the back side links move in opposed rotational directions. In this arrangement as shown in FIGS. 10 and 11, in the tilted position the front portion 50 extends at an acute angle relative to the back portion 52. Further in the tilted position of the front portion, the back front side link ends 62 and the front rod 64 which are immediately adjacent to the back portion, extend vertically above the back portion. As shown in FIGS. 18 and 19, in the tilted position of the front portion 50 the shelf 32 is enabled to hold beverage containers engaged with the front portion in a tilted position. In this position bottles of the type shown may be positioned to have the necks thereof extending upward from the base of the bottles which may be engaged with the inside of the front wall 68 and held in spaced apart relation by the projections 86 that extend between the recesses 88 on the horizontal edges of the inserts 58. As shown, in this tilted configuration additional bottles may be positioned in supported relation with the back portion 52 of the respective shelf.

In some exemplary arrangements the enclosure may be configured to include more vertically disposed pairs of slides than shelves. In such arrangements the user may selectively vertically space the shelves away from one another by engaging shelves with the different pairs of slides. Thus for example in some exemplary arrangements when the user chooses to position the front portion of the shelf in the tilted position such as is shown in FIGS. 10 and 11, the shelf immediately above can be positioned sufficiently vertically away from the shelf below so that the top ends of the bottles do not contact or interfere with horizontal movement of the shelf vertically above.

Alternatively in exemplary arrangements the configurable shelf 26 may have a front portion 50 movable to a retracted position in which the front portion vertically overlies or underlies the back portion 52 of the shelf. This is carried out in exemplary arrangements by rotating the back side links 70 about the rear pivots 74 to a retracted position in which the front portion extends in underlying relation of the rear portion 52. However in other arrangements the front portion may be configured to overlie the back portion in the retracted position.

Figure 12:
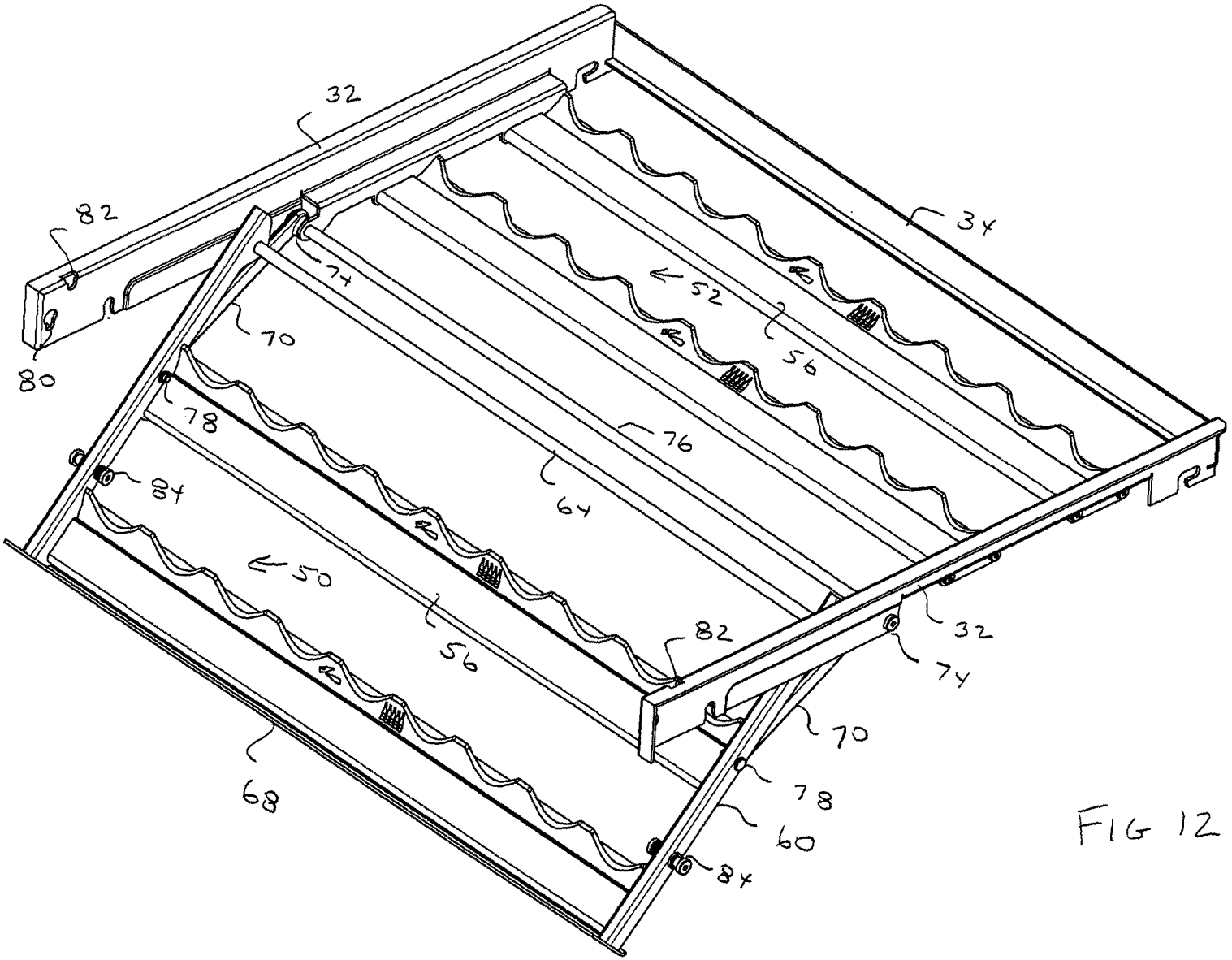
FIG. 12 is a top front right perspective view of the exemplary shelf shown with the front portion being moved toward the retracted position.
Figure 13:
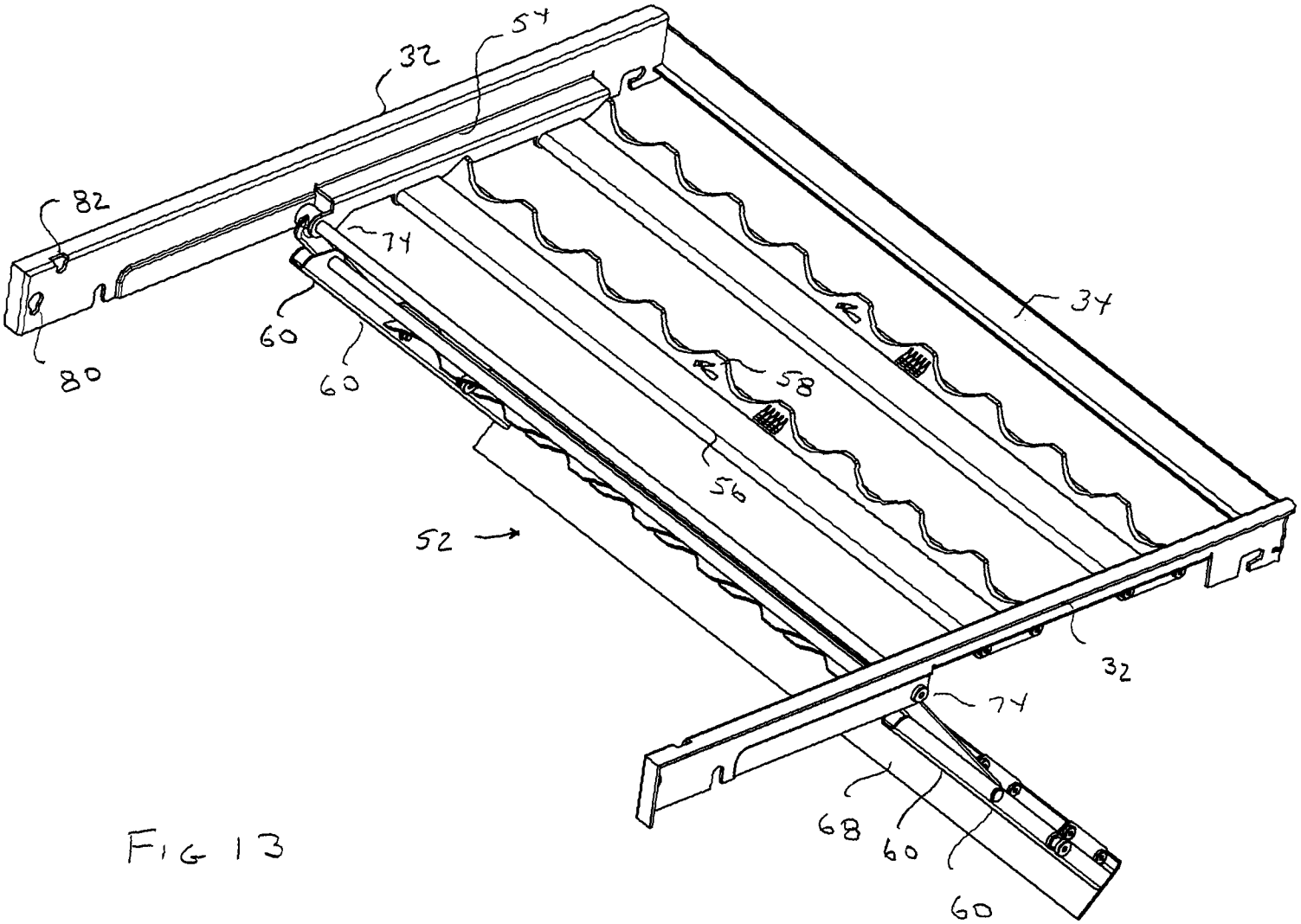
FIG. 13 is a back top left perspective view of the shelf as shown in FIG. 12.
Figure 14:
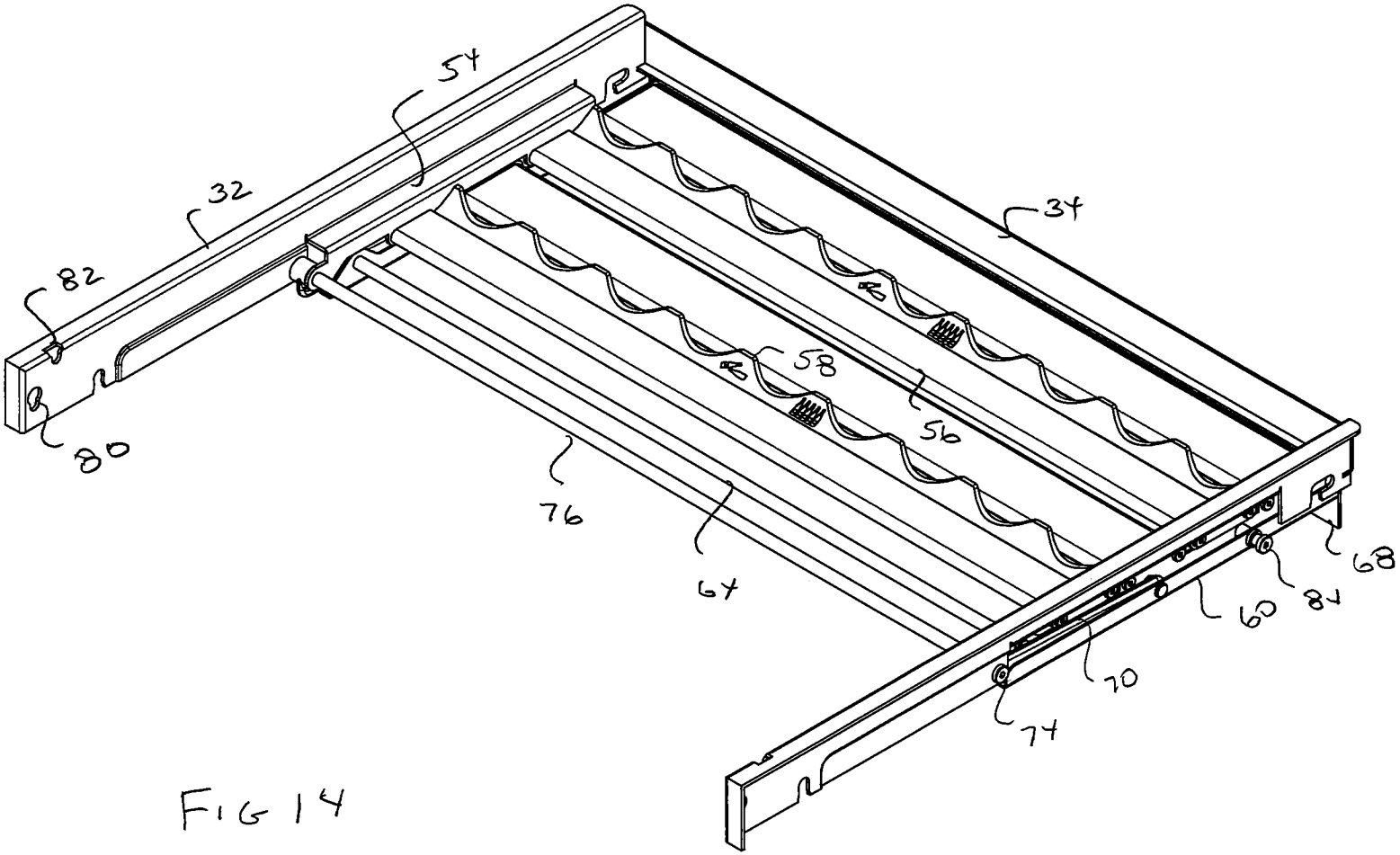
FIG. 14 is a top front right perspective view of the exemplary configurable shelf with the front portion shown in the retracted position.
Figure 15:
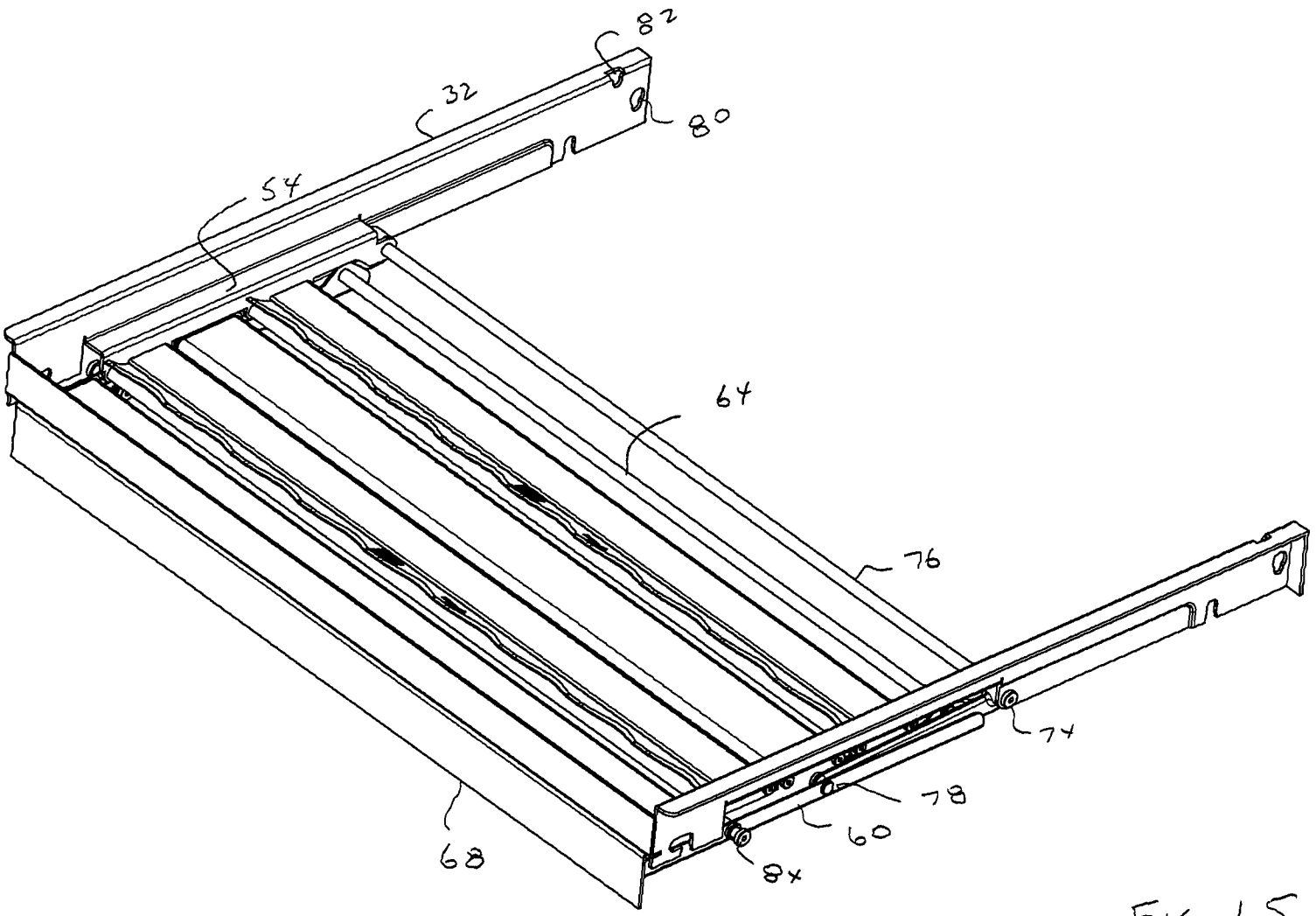
FIG. 15 is a back top left perspective view of the configurable shelf with the front portion in the retracted position as shown in FIG. 14.
Figure 16:
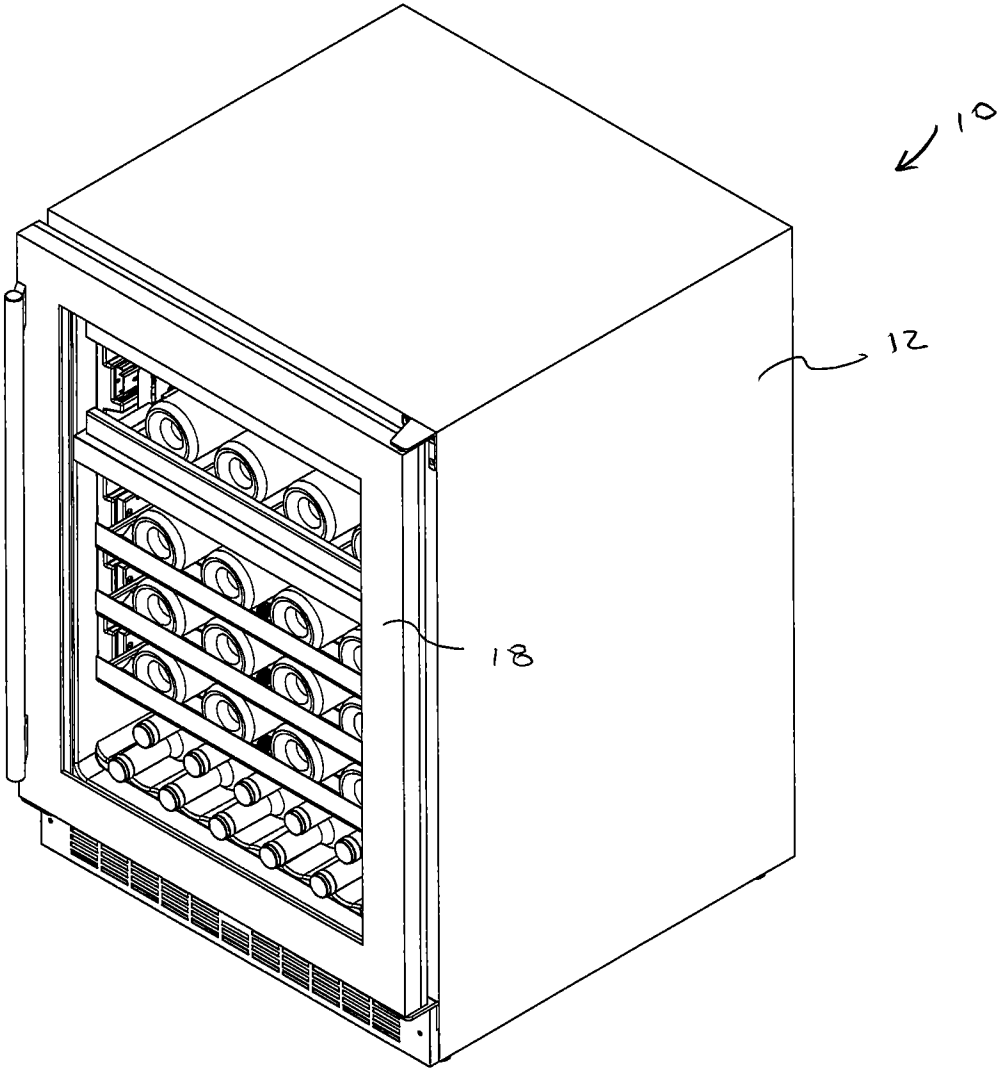
FIG. 16 is a top front right perspective view of the exemplary cooler showing an exemplary arrangement of the internal shelves supporting beverage containing bottles.

The movement of the exemplary front portion about the rear pivots 74 toward the retracted position is represented in FIGS. 12 and 13. This can be accomplished when the outward extending projections 84 have been disengage from apertures 80 and 82. In the retracted position of the front portion as shown in FIGS. 14 and 15 the back side links 70 and the front side links 60 extend rearward from the rear pivots 74. The front portion may be held in the retracted position by magnets, fasteners, apertures that engage the projecting members, or other suitable engaging structures. With the front portion moved to this retracted position, the forward area of the shelf is open. This enables the necks of bottles or other containers that may be tilted upward on the shelf immediately below to extend vertically upward to at least the level of the shelf above and into the open space at the front portion of the upper shelf. In the retracted position of the front portion, the back portion and the inserts thereon remain suitable for holding beverage containers in supported connection with the back portion. As can be appreciated these exemplary arrangements facilitate holding the beverage containers in the desired locations in supported connection with the shelves.

Of course as can be appreciated in exemplary arrangements the front portion may be returned to the flat shelf position or to the tilted position as may be desired by the user. Thus exemplary arrangements enable the user to readily reconfigure the shelf arrangement within the cooler. Further in exemplary arrangements the ability to releasably engage the shelves 26 and the slides 28 may also enable the shelves to be configured such that in the retracted position of the front portion of the shelf, the location of the open area is reversed so that space for bottles or containers extending upward from the shelf immediately below is at the inward side of the shelf. Thus for example in exemplary arrangements with the shelf having the retracted front portion positioned between the slides with open space at the back, the user may position tall bottles so they extend vertically upward from the shelf below into the open space at the back of the shelf immediately above. Of course it should be understood that these approaches are exemplary and in other arrangements other approaches to be used.

Figure 6:
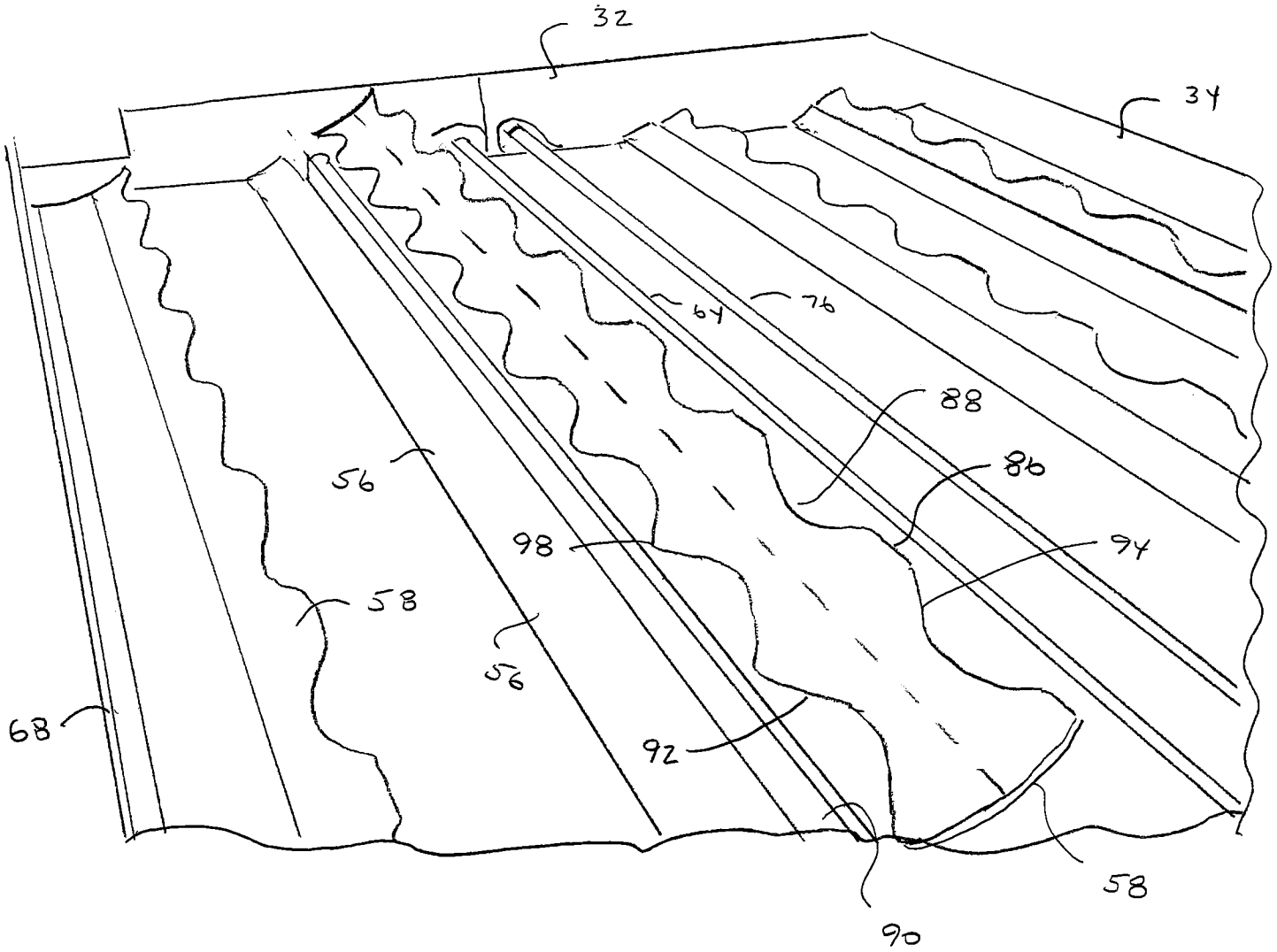
FIG. 6 is a perspective exploded view of an exemplary configurable shelf and a reversible insert that is configured to engage a slot of a shelf support plate.

As previously discussed, in exemplary arrangements the front portions 50 and the back portions 52 of the shelves each include horizontally extending shelf support plates 56 that have horizontally elongated slots that are configured to releasably receive inserts 58 therein. As represented in FIG. 6 in exemplary arrangements the slots 90 extend horizontally between the side walls 32. The slots are configured to receive a horizontal edge 92 of an insert therein. When the horizontal edge 92 is positioned within the slot an opposed horizontal edge 94 which includes horizontally spaced projections 86 and recesses 88 extends vertically above and outside of the slot.

In exemplary arrangements the recesses and projections conform with the configuration of outside walls of bottles or other containers of a given size. The exemplary projections 86 have a spaced configuration such that the projections extend intermediate of the containers and maintain the containers in the desired spaced relation. This helps to assure that containers in engaged relation with the shelf inserts maintain the desired positions and do not move under normal circumstances when the shelves are extended and retracted from the enclosure.

Further in exemplary arrangements each opposed horizontal edge of an insert includes projections and recesses that have a different configuration and/or spaced relationship. As a result the user may change the spaced relationship and/or configuration of the projections that are exposed outside and above the slot by reversing the exemplary insert and extending the currently exposed horizontal edge and the projections thereon so they extend within the slot. In exemplary arrangements the inserts may include visible indicia 96 thereon that indicate the particular spaced relationship of the projections that extend on each horizontal edge. Thus a user is enabled to assure that each of the inserts are configured in the same manner and with the projections having the same spaced configurations extending upward outside the slot.

In exemplary arrangements the inserts 58 are curved in transverse cross-section. As a result the projections 86 along one horizontal edge 94 extend at an obtuse angle relative to projections 98 that extend on the opposed transverse edge 92. Further in exemplary arrangements the inserts are comprised of resilient material. This enables the inserts to be extended in a respective slot 90 and held therein by the biasing force against the sides of the slot that is produced by the compression of the resilient material. Of course it should be understood that these approaches are exemplary and in other arrangements other approaches may be used. For example multiple inserts may be positioned within a respective slot and/or multiple separate slots may be utilized instead of a continuous slot.

Thus the exemplary arrangements achieve improved operation, eliminate difficulties encountered in the use of prior devices, and attain the useful results that are described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples, and the new and useful features are not limited to the exact features and configurations that have been shown and described.

It should be understood that the features and/or relationships associated with one exemplary arrangement can be combined with features and/or relationships from another exemplary arrangement to form other arrangements. That is, various features and/or relationships from various arrangements can be combined in further arrangements. The new and useful scope of the disclosure herein is not limited only to the exemplary arrangements that have been shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is a selectively configurable shelf that is movably mounted in operative connection with the enclosure, positioned in vertically disposed parallel relation with at least one of the other shelves, and movable between an outward position in which the selectively configurable shelf extends outward from the interior area through the opening and a back position in which the shelf is fully within the interior area, wherein each respective selectively configurable shelf includes a front portion and a back portion, wherein the front portion is closer to the opening when the selectively configurable shelf is in the back position, wherein the back portion is in an operatively fixed position relative to the shelf, wherein the front portion is rotationally movable relative to the back portion, wherein the front portion is configured to be releasably fixed in a plurality of positions relative to the back portion, wherein the positions include a flat shelf position in which the front portion is in co-planar relation with the back portion, a tilted position, wherein in the tilted position the front portion extends at an acute angle relative to the back portion and an inward end of the front portion that is immediately adjacent to the back portion extends above the back portion, and a retracted position, wherein in the retracted position a majority of the front portion extends in one or more of directly vertically overlying relation or directly vertically underlying relation with the back portion.

2. The apparatus according to claim 1 wherein a pair of immediately vertically adjacent shelves are selectively configurable shelves and have respective front portions movable between the flat shelf position, the tilted position and the retracted position, wherein the respective front portion of a lower shelf of the pair is positionable in the tilted position while the respective front portion of an upper shelf of the pair is in the retracted position, wherein a vertically open space extends in front of the back portion of the upper shelf, wherein there is vertical clearance above the tilted front portion of the lower shelf such that beverage containers in supported connection with the tilted front portion of the lower shelf are enabled to extend upwardly in the open space to at least a vertical level of the upper shelf.

3. The apparatus according to claim 1 wherein each respective selectively configurable shelf includes horizontally disposed side walls, wherein each side wall includes a first aperture and a second aperture, wherein in an operative position the respective first apertures and the second apertures of the side walls are horizontally aligned, wherein the front portion of each respective selectively configurable shelf is movably mounted horizontally intermediate of the side walls, and includes a pair of horizontally disposed aligned projections, wherein a respective projection extends outward on each transverse side of the front portion, wherein each projection is selectively lockable in engagement with a respective aperture, wherein the front portion of the respective selectively configurable shelf is in the flat shelf position when the projections are engaged with the first apertures, and the front portion of the respective selectively configurable shelf is in the tilted position when the projections are engaged with the second apertures.

4. The apparatus according to claim 1 wherein each respective selectively configurable shelf includes a pair of horizontally disposed side walls, wherein the respective front portion is movable intermediate of the side walls, wherein the respective front portion includes a pair of horizontally disposed front side links, wherein each of the front side links is disposed horizontally inwardly of an immediately adjacent side wall, and is movable along a direction parallel to the immediately adjacent side wall at least one support plate that extends horizontally intermediate of the front side links, a pair of horizontally disposed back side links, wherein each back side link is positioned inwardly of an immediately adjacent side wall, is rotatably movably mounted in operative connection with the immediately adjacent side wall at a first back side link end, and is rotatably movably mounted in operative connection with a respective front side link, wherein each of the front side links and back side links move in opposed rotational directions as the respective selectively configurable shelf is changed between the flat shelf position and the tilted position.

5. The apparatus according to claim 1 wherein each respective selectively configurable shelf includes a pair of horizontally disposed side walls, wherein the respective front portion is movable intermediate of the side walls, wherein the respective front portion includes a pair of horizontally disposed front side links, wherein each of the front side links is disposed horizontally inwardly of an immediately adjacent side wall, and is movable along a direction parallel to the immediately adjacent side wall, at least one support plate that extends horizontally intermediate of the front side links, a pair of horizontally disposed back side links, wherein each back side link is positioned inwardly of an immediately adjacent side wall, is rotatably movably mounted in operative connection with the immediately adjacent side wall at a first back side link end, is rotatably movably mounted in operative connection with a respective front side link, and wherein the respective front side link includes an elongated cross-sectional recess that is configured to receive at least a portion of the respective back side link therein, wherein each of the front side links and back side links move in opposed rotational directions as the respective shelf is changed between the flat shelf position and the tilted position, and wherein in the flat shelf position the back side link extends in the elongated cross-sectional recess.

6. The apparatus according to claim 1 wherein each respective selectively configurable shelf includes a pair of horizontally disposed side walls, wherein the respective front portion is movable intermediate of the side walls, wherein the respective front portion includes a pair of horizontally disposed front side links, wherein each of the front side links is disposed horizontally inwardly of an immediately adjacent side wall, is movable along a direction parallel to the immediately adjacent side wall, and includes a forward front side link end and a back front side link end, at least one support plate that extends horizontally intermediate of the front side links, a pair of horizontally disposed back side links, wherein each back side link is positioned inwardly of an immediately adjacent side wall, is rotatably movably mounted in operative connection with the immediately adjacent side wall adjacent a first back side link end, and is rotatably movably mounted in operative connection with a respective front side link at a second back side link end opposed of the first back side link end, wherein the second back side link end is rotatably engaged with the respective front side link intermediate of the forward front side link end and the back front side link end, wherein each of the front side links and back side links move in opposed rotational directions as the respective shelf is changed between the flat shelf position and the tilted position.

7. The apparatus according to claim 1 wherein each respective selectively configurable shelf includes a pair of horizontally disposed side walls, wherein each side wall includes a first side wall aperture and a second side wall aperture, wherein the respective front portion is movable intermediate of the side walls, wherein the respective front portion includes a pair of horizontally disposed front side links, wherein each of the front side links is disposed horizontally inwardly of an immediately adjacent side wall, is movable along a direction parallel to the immediately adjacent side wall, and includes a forward front side link end and a back front side link end, at least one support plate, wherein the at least one support plate extends horizontally intermediate of the front side links, a pair of horizontally disposed back side links, wherein each back side link is positioned inwardly of an immediately adjacent side wall, is rotatably movably mounted in operative connection with the immediately adjacent side wall adjacent a first back side link end, and is rotatably movably mounted in operative connection with a respective front side link at a second back side link end opposed of the first back side link end, wherein the second back side link end is rotatably engaged with the respective front side link at a front side link pivot which is intermediate of the forward front side link end and the back front side link end, wherein each respective front side link includes a horizontally extending front link projection, wherein the respective horizontally extending front link projection is disposed toward the forward front side link from the front side link pivot, wherein each of the front side links and back side links move in opposed rotational directions as the respective shelf is changed between the flat shelf position and the tilted position, and wherein the front portion of the respective shelf is in the flat shelf position when the first side wall apertures and the projections are in engagement, and wherein the front portion of the respective shelf is in the tilted position when the second side wall apertures and the projections are in engagement.

8. The apparatus according to claim 1 wherein each respective selectively configurable shelf includes a pair of horizontally disposed side walls, wherein the respective front portion is movable intermediate of the side walls, wherein the respective front portion includes a pair of horizontally disposed front side links, wherein each of the front side links is disposed horizontally inwardly of an immediately adjacent side wall, is movable along a direction parallel to the immediately adjacent side wall, and includes a forward front side link end and a back front side link end, at least one support plate that extends horizontally intermediate of the front side links, a pair of horizontally disposed back side links, wherein each back side link is positioned inwardly of an immediately adjacent side wall, is rotatably movably mounted in operative connection with the immediately adjacent side wall about a rear pivot adjacent a first back side link end, and is rotatably movably mounted in operative connection with a respective front side link adjacent a second back side link end opposed of the first back side link end, wherein the second back side link end is rotatably engaged with the respective front side link intermediate of the forward front side link end and the back front side link end, wherein the respective front portion is rotatable about the rear pivots from each of the tilted position and the flat shelf position to underlie the back portion when in the retracted position.

9. The apparatus according to claim 1 wherein each respective selectively configurable shelf includes a pair of horizontally disposed side walls, wherein the respective front portion is movable intermediate of the side walls, wherein the respective front portion includes a pair of horizontally disposed front side links, wherein each of the front side links is disposed horizontally inwardly of an immediately adjacent side wall, is movable along a direction parallel to the immediately adjacent side wall, and includes a forward front side link end and a back front side link end, and at least one support plate that extends horizontally intermediate of the front side links, a pair of horizontally disposed back side links, wherein each back side link is positioned inwardly of an immediately adjacent side wall, is rotatably movably mounted in operative connection with the immediately adjacent side wall adjacent a first back side link end, and is rotatably movably mounted in operative connection with a respective front side link adjacent a second back side link end opposed of the first back side link end, wherein the second back side link end is rotatably engaged with the respective front side link intermediate of the forward front side link end and the back front side link end, a front rod, wherein the front rod extends horizontally between the back front side link ends of the front side links, wherein each of the front side links and back side links move in opposed rotational directions as the respective shelf is changed between the flat shelf position and the tilted position.

10. The apparatus according to claim 1 wherein each respective selectively configurable shelf includes a pair of horizontally disposed side walls, wherein the respective front portion is movable intermediate of the side walls, wherein the respective front portion includes a pair of horizontally disposed front side links, wherein each of the front side links is disposed horizontally inwardly of an immediately adjacent side wall, is movable along a direction parallel to the immediately adjacent side wall, and includes a forward front side link end and a back front side link end, at least one support plate that extends horizontally intermediate of the front side links, a pair of horizontally disposed back side links, wherein each back side link is positioned inwardly of an immediately adjacent side wall, is rotatably movably mounted in operative connection with the immediately adjacent side wall about a back pivot adjacent a first back side link end, and is rotatably movably mounted in operative connection with a respective front side link adjacent a second back side link end opposed of the first back side link end, a back rod, wherein the back rod extends along an axis of the back pivot and horizontally between the first back side link ends, wherein the respective second back side link end is rotatably engaged with the respective front side link intermediate of the forward front side link end and the back front side link end, wherein each of the front side links and back side links move in opposed rotational directions as the respective shelf is changed between the flat shelf position and the tilted position.

11. The apparatus according to claim 1 wherein the respective shelf front portion of each respective selectively configurable shelf includes a shelf support plate, wherein the shelf support plate extends horizontally in an operative position and includes at least one horizontally elongated slot, an insert including a plurality of horizontally spaced projections, wherein the insert is removably positionable in the slot such that the spaced projections extend outward above the slot, wherein the projections are configured to extend between beverage containers.

12. The apparatus according to claim 1 wherein the respective shelf front portion of each respective selectively configurable shelf includes a shelf support plate, wherein the shelf support plate extends horizontally in an operative position and includes at least one horizontally elongated slot, an insert including a plurality of horizontally spaced first projections that have a first spaced configuration along a horizontal edge, and a plurality of horizontally spaced second projections having a second spaced configuration along an opposed horizontal edge, wherein the insert is removably positionable in the slot such that either the first spaced projections extend outward above the slot or the second spaced projections extend outward above the slot.

13. The apparatus according to claim 1 wherein the respective shelf front portion of each respective selectively configurable shelf includes a shelf support plate, wherein the shelf support plate extends horizontally in an operative position and includes at least one horizontally elongated slot, an insert including a plurality of horizontally spaced first projections having a first spaced configuration along a horizontal edge, and a plurality of horizontally spaced second projections having a second spaced configuration along an opposed horizontal edge, wherein the insert in transverse cross section is curved such that the first spaced projections extend at an obtuse angle to the second spaced projections, wherein the insert is removably positionable in the slot such that either the first spaced projections extend outside and above the slot or the second spaced projections extend outside and above the slot.

14. The apparatus according to claim 1 wherein the respective shelf front portion of each respective selectively configurable shelf includes a shelf support plate, wherein the shelf support plate in an operative position extends horizontally and includes at least one horizontally elongated slot, an insert comprised of resilient material that includes a plurality of horizontally spaced first projections having a first spaced configuration along one horizontal edge, and a plurality of horizontally spaced second projections having a second spaced configuration along an opposed horizontal edge, wherein the insert is removably positionable in the slot such that either the first spaced projections extend outward and above the slot or the second spaced projections extend outward and above the slot.

15. The apparatus according to claim 1 wherein on each respective selectively configurable shelf, each of the respective shelf front portion and respective shelf back portion includes a respective shelf support plate, wherein each shelf support plate in an operative position extends horizontally and includes at least one horizontally elongated slot, a plurality of inserts, wherein each insert includes a plurality of horizontally spaced first projections having a first spaced configuration along a horizontal edge, and a plurality of horizontally spaced second projections having a second spaced configuration along an opposed horizontal edge, wherein each insert is removably positionable in each respective slot such that either the first spaced projections extend outward and above the respective slot or the second spaced projections extend outward and above the respective slot, wherein each insert includes visible indicia thereon that is indicative of the spaced configuration associated with the projections that extend on each horizontal edge, whereby the shelf is selectively configured to hold different sized containers.

16. The apparatus according to claim 1 wherein each selectively configurable shelf includes a respective pair of horizontally disposed side walls, wherein the respective front portion of the respective shelf is rotationally movably mounted intermediate of the side walls, and further comprising:

a pair of horizontally disposed slides, wherein each of the slides is in fixed operative connection with the enclosure, and is movable between a slide retracted position wherein the slide is within the interior area, and a slide extended position wherein the slide extends further toward the opening, wherein each respective side wall of each respective selectively configurable shelf is releasably engaged with a respective slide.

17. Apparatus comprising:

a cooler configured for holding beverage containers including:

an enclosure, wherein the enclosure bounds an interior area, and includes an opening that provides access from outside the enclosure to the interior area, a door, wherein the door is movably mounted in operative connection with the enclosure, is movable between a closed door position in which the opening is closed by the door, and an open door position in which the interior area is accessible from outside the enclosure through the opening, a plurality of shelves, wherein each of the shelves is in vertically disposed parallel relation with at least one of the other shelves, wherein at least one of the shelves is selectively configurable, wherein each selectively configurable shelf includes a front portion and a back portion, wherein in a flat shelf position the front portion is closer to the opening than the back portion, wherein the front portion is rotationally movable relative to the back portion, wherein the front portion is configured to be movable to a plurality of positions, wherein the positions include the flat shelf position in which the front portion is in co-planar relation with the back portion, a tilted position, wherein the front portion extends at an acute angle relative to the back portion, and a retracted position, wherein in the retracted position the front portion extends parallel to and in one or more of underlying or overlying relation with the back portion.

18. The apparatus according to claim 17 wherein the cooler contains a pair of immediately vertically adjacent selectively configurable shelves, wherein with the front portion of a lower shelf of the pair in the tilted position and the front portion of an upper shelf of the pair in the retracted position, an open space extends in front of the back portion of the upper shelf such that vertical clearance is provided above the front portion of the lower shelf such that beverage containing bottles in engagement with the front portion of the lower shelf are enabled to extend in the open space and vertically above at least a portion of the upper shelf.

19. The apparatus according to claim 17 wherein each respective selectively configurable shelf includes at least one horizontally extending shelf support plate, wherein the shelf support plate includes a horizontally extending elongated slot, at least one insert including projections, wherein the at least one insert is configured to extend in the slot with the projections extending vertically above and outside the slot, wherein the projections are adapted to extend between containers that are operatively supported on the shelf.

20. The apparatus according to claim 17 wherein the back portion is in fixed immovable connection with the respective selectively configurable shelf, and wherein in the retracted position a majority of the front portion extends in directly vertically underlying relation or in directly vertically overlying relation with the back portion.

21. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is a selectively configurable shelf that is movably mounted in operative connection with the enclosure, positioned in vertically disposed parallel relation with at least one of the other shelves, and movable between an outward position in which the shelf extends outward from the interior area through the opening and a back position in which the shelf is fully within the interior area, wherein each selectively configurable shelf includes a pair of horizontally disposed side walls, wherein each side wall includes a respective first aperture and second aperture, a front portion and a back portion, wherein the front portion is closer to the opening when the shelf is in the back position, is rotationally movable relative to the back portion intermediate of the side walls, includes a pair of horizontally disposed projections, wherein a respective projection extends outward on each transverse side of the first portion, wherein the front portion is configured to be releasably fixed in a plurality of positions relative to the back portion, wherein the positions include a flat shelf position in which the front portion is in co-planar relation with the back portion and each respective projection is engaged with a respective first aperture, a tilted position, wherein in the tilted position the front portion extends at an acute angle relative to the back portion, an inward end of the front portion that is immediately adjacent to the back portion extends above the back portion, and each respective projection is engaged with a respective second aperture, and a retracted position, wherein in the retracted position the front portion extends in at least one of overlying or underlying relation with the back portion.

22. Apparatus comprising:

a cooler configured for holding beverage containers including:

an enclosure, wherein the enclosure bounds an interior area, and includes an opening that provides access from outside the enclosure to the interior area, a door, wherein the door is movably mounted in operative connection with the enclosure, is movable between a closed door position in which the opening is closed by the door, and an open door position in which the interior area is accessible from outside the enclosure through the opening, a plurality of shelves, wherein each of the shelves is in vertically disposed parallel relation with at least one of the other shelves, wherein at least one of the shelves is selectively configurable, wherein each selectively configurable shelf includes a first portion and a second portion, wherein in a flat shelf position the first portion is horizontally disposed from the second portion, wherein the second portion is in fixed immovable connection with the respective shelf, wherein the first portion is rotationally movable relative to the second portion, wherein the first portion is configured to be movable to a plurality of positions, wherein the positions include the flat shelf position in which the first portion is in co-planar relation with the second portion, a tilted position, wherein the first portion extends at an acute angle relative to the second portion, and a retracted position, wherein in the retracted position a majority of the first portion extends parallel to and in one or more of directly vertically underlying relation or in directly vertically overlying relation of the second portion.

23. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable between an outward position in which the shelf extends outward from the interior area through the opening and a back position in which the shelf is fully within the interior area, wherein each respective at least one shelf is selectively configurable and includes a shelf support plate, wherein the shelf support plate extends horizontally in an operative position and includes at least one horizontally elongated slot, an insert including a plurality of horizontally spaced projections, wherein the insert is removably positionable in the slot such that the spaced projections extend outward above the slot, wherein the projections are configured to extend between beverage containers.

* * * * *